US009847003B2

(12) United States Patent
Sayegh et al.

(10) Patent No.: US 9,847,003 B2
(45) Date of Patent: Dec. 19, 2017

(54) CABLE ALARM TAG

(75) Inventors: Adel O. Sayegh, Rancho Cucamonga, CA (US); Edgardo Redublo, Chino Hills, CA (US); Weiliang Tong, Hangzhou (CN); Mingxing Chen, Hangzhou (CN)

(73) Assignee: USS Technologies, LLC, Rancho Cucamonga, CA (US)

( * ) Notice: Subject to any disclaimer, the term of this patent is extended or adjusted under 35 U.S.C. 154(b) by 369 days.

(21) Appl. No.: 12/790,918

(22) Filed: May 31, 2010

(65) Prior Publication Data

US 2013/0147625 A1 Jun. 13, 2013

Related U.S. Application Data

(60) Provisional application No. 61/183,060, filed on Jun. 1, 2009.

(51) Int. Cl.

| | |
|---|---|
| ***G08B 13/14*** | (2006.01) |
| ***G08B 13/24*** | (2006.01) |
| ***H01B 7/00*** | (2006.01) |
| *E05B 73/00* | (2006.01) |
| *G08B 29/04* | (2006.01) |
| *G08B 29/02* | (2006.01) |

(52) U.S. Cl.

CPC ..... *G08B 13/2451* (2013.01); *E05B 73/0005* (2013.01); *G08B 13/1445* (2013.01); *G08B 13/1463* (2013.01); *H01B 7/00* (2013.01); *E05B 73/00* (2013.01); *E05B 73/0017* (2013.01); *E05B 73/0029* (2013.01); *G08B 13/14* (2013.01); *G08B 13/1409* (2013.01); *G08B 13/1454* (2013.01); *G08B 29/02* (2013.01); *G08B 29/04* (2013.01); *G08B 29/046* (2013.01)

(58) Field of Classification Search

CPC ..... G08B 13/14; G08B 13/1409; G08B 13/1445; G08B 13/1454; G08B 13/1463; G08B 29/046; E05B 73/00; E05B 73/0005; E05B 73/0017; E05B 73/0029

USPC ..... 340/568.1, 568.2, 571, 568.4

See application file for complete search history.

(56) References Cited

U.S. PATENT DOCUMENTS

| | | | |
|---|---|---|---|
| 639,196 | A | 12/1899 | Fehling |
| 673,612 | A | 5/1901 | Appleby |
| 886,905 | A | 5/1908 | Ward |

(Continued)

FOREIGN PATENT DOCUMENTS

| | | | |
|---|---|---|---|
| CN | 2572495 | Y | 9/2003 |

*Primary Examiner* — Benyam Haile

(74) *Attorney, Agent, or Firm* — Milord A. Keshishian

(57) ABSTRACT

The present invention provides an improved cable that includes at least one insulated conductor insulated from and within and inside a insulated second conductor, with both conductors connected with both ends with a cable alarm tag to form a closed electrical circuit, with the loop of the cable connected to an article for securing the article. With the cable of the present invention, if severed, the use of jumper cables will maintain the electrical circuit loop closed for the outer conductor only, but not the insulated inner conductor that is within and inside the outer conductor. Therefore, when severing the cable to disconnect and discontinue the physical loop to remove the secured article, even if cable jumpers are used, the insulated inner conductor will remain open circuited when the cable is cut, resulting in trigger of the alarm.

9 Claims, 17 Drawing Sheets

(56) References Cited

U.S. PATENT DOCUMENTS

| | | | | | |
|---|---|---|---|---|---|
| 895,403 | A | | 8/1908 | Jackson | |
| 1,083,612 | A | | 1/1914 | Hooker | |
| 1,124,130 | A | | 1/1915 | Grant | |
| 1,141,245 | A | | 6/1915 | Gillespie | |
| 1,165,320 | A | | 12/1915 | Clary | |
| 1,165,816 | A | | 12/1915 | Tichenor | |
| 1,657,190 | A | | 1/1928 | Ballou | |
| 1,992,868 | A | | 2/1935 | Krause | |
| 2,002,946 | A | | 5/1935 | Jacobs | |
| 2,574,967 | A | | 11/1951 | Gossner et al. | |
| 3,395,555 | A | | 8/1968 | Hickman | |
| 3,397,849 | A | | 8/1968 | Hansen | |
| 3,444,547 | A | * | 5/1969 | Surek | 340/650 |
| 3,466,668 | A | | 9/1969 | Ochiai | |
| 3,568,902 | A | | 3/1971 | Highberger | |
| 3,611,760 | A | | 10/1971 | Muther | |
| 3,831,407 | A | | 8/1974 | Coleman | |
| 3,906,758 | A | | 9/1975 | Hurwitt | |
| 3,929,300 | A | | 12/1975 | Lindqvist | |
| 4,004,440 | A | | 1/1977 | Dreyer | |
| 4,071,023 | A | | 1/1978 | Gregory | |
| 4,086,795 | A | | 5/1978 | Foster et al. | |
| 4,132,987 | A | * | 1/1979 | Devereaux | 340/506 |
| 4,418,551 | A | | 12/1983 | Kochackis | |
| 4,665,724 | A | | 5/1987 | Sakai | |
| 4,756,171 | A | | 7/1988 | Homar | |
| 4,827,577 | A | | 5/1989 | Vaux | |
| 4,896,517 | A | | 1/1990 | Ling | |
| 4,930,324 | A | | 6/1990 | Meier | |
| 4,949,679 | A | | 8/1990 | Wolfer | |
| 5,144,821 | A | | 9/1992 | Ernesti et al. | |
| 5,156,028 | A | | 10/1992 | Jiang | |
| 5,193,368 | A | | 3/1993 | Ling | |
| 5,345,947 | A | | 9/1994 | Fisher | |
| 5,379,496 | A | | 1/1995 | Krauss | |
| 5,517,836 | A | | 5/1996 | Hong | |
| 5,551,447 | A | | 9/1996 | Hoffman et al. | |
| 5,581,853 | A | | 12/1996 | Miller et al. | |
| 5,598,727 | A | | 2/1997 | White | |
| 5,610,587 | A | | 3/1997 | Fujiuchi et al. | |
| 5,671,506 | A | | 9/1997 | Eliasson | |
| 5,687,455 | A | | 11/1997 | Alexander | |
| 5,687,456 | A | | 11/1997 | Chang | |
| 5,722,266 | A | | 3/1998 | Yeager et al. | |
| 5,794,464 | A | | 8/1998 | Yeager et al. | |
| 5,832,752 | A | | 11/1998 | Zeller | |
| 5,856,782 | A | | 1/1999 | Sasagawa et al. | |
| 5,959,532 | A | | 9/1999 | Fujiuchi et al. | |
| 5,960,652 | A | | 10/1999 | Marmstad | |
| 6,040,764 | A | | 3/2000 | Crisci | |
| 6,092,401 | A | | 7/2000 | Sankey et al. | |
| 6,128,932 | A | | 10/2000 | Mainetti et al. | |
| 6,188,320 | B1 | | 2/2001 | Kolton et al. | |
| 6,237,375 | B1 | | 5/2001 | Wymer | |
| 6,404,341 | B1 | | 6/2002 | Reid | |
| 6,420,971 | B1 | * | 7/2002 | Leck et al. | 340/542 |
| 6,550,293 | B1 | | 4/2003 | Delegato et al. | |
| 6,570,502 | B2 | * | 5/2003 | Matsuo | 340/568.2 |
| 6,681,603 | B1 | | 1/2004 | Yu | |
| D492,215 | S | | 6/2004 | Lu | |
| 6,755,055 | B2 | | 6/2004 | Sedon et al. | |
| 7,129,841 | B2 | | 10/2006 | Feibelman | |
| 7,162,899 | B2 | | 1/2007 | Fawcett et al. | |
| 7,168,275 | B2 | | 1/2007 | Fawcett et al. | |
| D543,590 | S | | 5/2007 | Feibelman | |
| 7,221,274 | B2 | | 5/2007 | Fawcett et al. | |
| 7,227,467 | B2 | | 6/2007 | Feibelman | |
| 7,251,966 | B2 | | 8/2007 | Fawcett et al. | |
| 7,272,962 | B2 | | 9/2007 | Benda et al. | |
| 7,474,209 | B2 | * | 1/2009 | Marsilio et al. | 340/568.1 |
| 7,481,086 | B2 | | 1/2009 | Fawcett et al. | |
| 7,518,521 | B2 | | 4/2009 | Feibelman | |
| 7,626,501 | B2 | | 12/2009 | Feibelman | |
| 2003/0182763 | A1 | | 10/2003 | Jeffries | |
| 2006/0145848 | A1 | * | 7/2006 | Marsilio et al. | 340/568.2 |
| 2006/0220848 | A1 | | 10/2006 | Tropper | |
| 2007/0012772 | A1 | | 1/2007 | Cooper | |
| 2010/0101283 | A1 | | 4/2010 | Xiaobin | |

* cited by examiner

CABLE ALARM TAG

CROSS-REFERENCE TO RELATED APPLICATIONS

This Application claims the benefit of priority of the U.S. Utility Provisional Patent Application No. 61/183,060, filed Jun. 1, 2009, the entire disclosure of which is expressly incorporated by reference herein.

BACKGROUND OF THE INVENTION (1) Field of the Invention

This invention relates to electronic article surveillance (EAS) system and, more particularly to cable alarm tags with an auxiliary alarm triggering mechanism.

(2) Description of Related Art

Most convention cable alarm tags include a cable that has a single conductor that connects at both of its ends with the cable alarm tag to form a closed electrical circuit, with the loop of the cable connected to an article for securing the article. With the conventional cables having a single conductor, users may easily use jumper cables to maintain the closed electrical circuit loop while severing the cable to disconnect and discontinue the physical loop (which is electrically bridged by the jumpers) to remove the secured article without triggering an alarm.

Accordingly, in light of the current state of the art and the drawbacks to current cable alarm tags mentioned above, there remains a long standing and continuing need for an advance in the art of EAS and theft deterrent cable alarm tags that makes the tags more difficult to defeat while providing a secure and reliable engagement of the article to be monitored.

BRIEF SUMMARY OF THE INVENTION

An exemplary optional aspect of the present invention provides a cable, comprising:

a sense loop cable, having inner conductors enclosed within and inside outer conductors;

the inner conductors longitudinally insulated from one another and from the outer conductors by inner dielectric layers, with an outermost outer conductor of outer conductors longitudinally insulated by an outer dielectric layer;

a first distal end of the cable is comprised of short-circuited first end of the inner and outer conductors, and a second distal end of the cable is comprised of second end of the inner and outer conductors connected to respective ground (GND) and High, forming the sense loop cable;

wherein the shorted-circuited first end of the inner and outer conductors comprises electrical and mechanically connection of a first end of the inner and outer conductors;

wherein the second end of the inner and outer conductors comprises electrical and mechanically connection with a Printed Circuit Board (PCB).

Another exemplary optional aspect of the present invention provides a cable, wherein:

the first distal end includes a locking plug that encapsulates the short-circuited first end of the one or more inner and outer conductors.

Still another An exemplary optional aspect of the present invention provides a cable, wherein:

the locking plug interlocks with and is accommodated by an actuator of an alarm tag.

Yet another exemplary optional aspect of the present invention provides a cable, cable, wherein:

the second distal end includes a conductive connector that secures the inner and outer conductors, and securely maintains an extension of the outer conductors, with the second distal end inner and outer conductors coupled with one of microprocessor and ground (GND).

A further exemplary optional aspect of the present invention provides a cable, wherein:

at least one conductor is an internal spirally-wrapped electrical conductive cord for added mechanical strength.

An exemplary optional aspect of the present invention provides a cable, comprising:

a sense loop cable, having a conductor and at least one auxiliary conductor enclosed within and inside the conductor;

the auxiliary conductor longitudinally insulated from the conductor by an inner dielectric layer, with the conductor longitudinally insulated from outside by an outer dielectric layer;

a first distal end of the cable is comprised of short-circuiting a first end of the conductor with the auxiliary conductor, and a second distal end of the cable is comprised of a second end of the conductor and the auxiliary conductor coupled with one of a ground and microprocessor.

An exemplary optional aspect of the present invention provides cable alarm tag, comprising:

a sense loop conductive cable, having a conductor and at least one auxiliary conductor enclosed within and inside the conductor;

the auxiliary conductor longitudinally insulated from the conductor by an inner dielectric layer, with the conductor longitudinally insulated from outside by an outer dielectric layer;

a first distal end of the cable is comprised of a locking plug that encapsulates first ends of the conductor with the auxiliary conductor, with the first ends of the conductor and the auxiliary conductor short-circuited;

a second distal end of the cable is comprised of second ends of the conductor and the auxiliary conductor, with the first and second distal ends of the cable forming the sense loop conductive cable, with the second distal end of the cable coupled with an alarm device of the alarm tag.

Still another exemplary optional aspect of the present invention provides cable alarm tag, wherein:

the locking plug is accommodated in a locking channel of an internal chamber of a housing component of an alarm tag, and inserted within a transversely oriented hollow portion of an actuator and locked when the locking plug is fully inserted and the actuator is moved to an active position; and when fully inserted, a base of the locking plug contacts and activates a first plunger of a first plunger switch; with the first plunger switch having a first output coupled with a first input line of a microprocessor for activation of the alarm device of the alarm tag.

A further exemplary optional aspect of the present invention provides cable alarm tag, wherein:

the second distal end of the cable is further coupled with a second input line of a microprocessor; and severing any one of the auxiliary and outer conductors would pull one of the first and second input line signals to the microprocessor to a high, triggering an alarm signal.

An exemplary optional aspect of the present invention provides cable alarm tag, comprising:

a locking cable that is coupled with a housing of an alarm tag;

the housing of the alarm tag includes:

a first member coupled with a second member, forming a hollow internal chamber within which is mounted an alarm system, and a first side that includes a first aperture for accommodating an actuator switch;

the first member includes a visual indicator aperture for viewing of a visual indicator device, and a triggering unit that senses and generates surveillance signals to trigger an alarm;

the second member includes a protuberance that houses a clutch;

the first member and the second member include perforated areas that form the grill-openings of the housing for output of audio indicator.

Another exemplary optional aspect of the present invention provides cable alarm tag, wherein:

the locking cable includes:

a sense loop cable, having one or more inner conductors enclosed within and inside one or more outer conductors;

the one or more inner conductors longitudinally insulated from one another and from the one or more outer conductors by one or more inner dielectric layers, with an outermost outer conductor of the one or more outer conductors longitudinally insulated by an outer dielectric layer;

a first distal end of the cable is comprised of short-circuiting a first end of the one or more inner and outer conductors, and a second distal end of the cable is comprised of a second end of the one or more inner and outer conductors coupled with a Printed Circuit Board (PCB) to form the sense loop cable.

Still a further exemplary optional aspect of the present invention provides cable alarm tag, wherein:

the first distal end includes a locking plug that encapsulates the short-circuited first end of the one or more inner and outer conductors.

Yet a further exemplary optional aspect of the present invention provides cable alarm tag, wherein:

the locking plug interlocks with and is accommodated by the actuator switch.

Anther exemplary optional aspect of the present invention provides cable alarm tag, wherein:

the second distal end includes a conductive connector that secures the one or more inner and outer conductors, and securely maintains an extension of the one or more outer conductors, with the one or more inner and outer conductors coupled with at least one input of a microprocessor of the alarm system.

Yet another exemplary optional aspect of the present invention provides cable alarm tag, wherein:

at least one conductor is an internal spirally-wrapped electrical conductive cord for added mechanical strength.

Still another exemplary optional aspect of the present invention provides cable alarm tag, wherein:

the locking plug is accommodated in a locking channel of the internal chamber of the first member of the housing the alarm tag, and inserted within a transversely oriented hollow portion of the actuator switch and locked when the locking plug is fully inserted and the actuator switch is moved to an active position;

when fully inserted, a base of the locking plug contacts and activates a first plunger of a first plunger switch; with the first plunger switch having a first output coupled with a first input line of the microprocessor for activation of the alarm system of the alarm tag.

A further exemplary optional aspect of the present invention provides cable alarm tag, wherein:

the second distal end of the cable is further coupled with a second input line of the microprocessor.

Still a further exemplary optional aspect of the present invention provides cable alarm tag, wherein:

the actuator switch is comprised of a second transversally oriented clutch aperture, perpendicular the first member to accommodate the clutch housed in the protuberance of the second member, which clutch locks in the actuator in the active position against a biasing mechanism;

the actuator switch further includes a flange that actuates a switch arm that contacts a second plunger switch of a second plunger, which switches power to the alarm system of the alarm tag.

Another exemplary optional aspect of the present invention provides cable alarm tag, wherein:

alarm system, includes:

a general purpose microprocessor with an internal memory that includes a set of instructions and mounted on a printed circuit board;

the microprocessor receives one or more input signals from one or more input periphery devices and generates one or more processed output signals for actuation of one or more periphery output devices;

one of the one or more input periphery devices is the sensed loop conductive cable, with the second distal end coupled with one of a one or more inputs of the microprocessor, and with the locking plug activates the first plunger of the first plunger switch; with the first plunger switch having a first output coupled with a second input of the microprocessor for activation.

Yet another exemplary optional aspect of the present invention provides cable alarm tag cable alarm, wherein:

the internal memory of the microprocessor is an EEPROM that includes at least executable data for modifying alarm settings of the cable alarm tag.

Still another exemplary optional aspect of the present invention provides cable alarm tag, wherein:

the periphery output devices include audio and visual devices based.

A further exemplary optional aspect of the present invention provides cable alarm tag, wherein:

a first input periphery device is an electronic article surveillance (EAS) device coupled with an EAS connector, with the EAS device comprised of a ferrite unit that is capable of receiving and transmitting signals;

a first output of the EAS connector is coupled with ground, and a second output of the EAS connector is coupled with an amplifier to generate an amplified signal of the EAS device;

the amplifier is comprised of a current limiting resistor that couples the input from the EAS connector to a base of a transitory, with the transistor functioning to amplify the current from EAS connector;

the transistor includes a first end coupled to power supply Vcc and a second end coupled to ground via an RC unit;

the amplified signal of the EAS device is input to microprocessor as one of one or more input signals.

Still a further exemplary optional aspect of the present invention provides cable alarm tag, wherein:

one of the one or more processed output signals is a pulsed output signal to one of the one or more periphery output devices for actuation of a transducer for generating an audio alarm signal.

Yet a further exemplary optional aspect of the present invention provides cable alarm tag, wherein:

the transducer is actuated by an amplified pulsed output signal that is output from the microprocessor and amplified by a first output amplifier;

the first output amplifier is comprised of a transistor with a first end coupled to ground, a second end coupled to a transformer of the transducer, and a third end that is coupled to current limiting resistor, with the transistor providing an amplified pulsed output signal to alternately pull the transformer to ground, where pulsed outputs from the transformer drive a ceramic transducer.

Another exemplary optional aspect of the present invention provides cable alarm tag, wherein:

severing any one or more of the conductors would pull the input line signals to the microprocessor to a high, triggering an alarm signal.

An exemplary optional aspect of the present invention provides a method for power management of an alarm, comprising:

determining if power ON;

if power is ON, then initializing and determining if a supplied power is greater than a first threshold;

if the supplied power is not greater then the first threshold, ceasing the operations; otherwise, determining if supplied power is greater than a second threshold;

if the supplied power is not greater than a second threshold, outputting a low power supply indicator and arming the alarm; otherwise, generating indicators that the alarm is armed.

Another exemplary optional aspect of the present invention provides a method for power management of an alarm, further comprising:

determining if an antenna signal is received for triggering an alarm;

if an antenna signal is received, triggering an alarm, otherwise, determine if the alarm is tampered and triggering an alarm if the alarm is tampered.

Still another exemplary optional aspect of the present invention provides a method for power management of an alarm, wherein:

tampering includes severing a cable of a cable alarm tag.

Such stated advantages of the invention are only examples and should not be construed as limiting the present invention. These and other features, aspects, and advantages of the invention will be apparent to those skilled in the art from the following detailed description of preferred non-limiting exemplary embodiments, taken together with the drawings and the claims that follow.

BRIEF DESCRIPTION OF THE DRAWINGS

It is to be understood that the drawings are to be used for the purposes of exemplary illustration only and not as a definition of the limits of the invention. Throughout the disclosure, the word "exemplary" is used exclusively to mean "serving as an example, instance, or illustration." Any embodiment described as "exemplary" is not necessarily to be construed as preferred or advantageous over other embodiments.

Referring to the drawings in which like reference character(s) present corresponding part(s) throughout.

DETAILED DESCRIPTION OF THE INVENTION

The detailed description set forth below in connection with the appended drawings is intended as a description of presently preferred embodiments of the invention and is not intended to represent the only forms in which the present invention may be constructed and or utilized.

For purposes of illustration, programs and other executable program components are illustrated herein as discrete blocks, although it is recognized that such programs and components may reside at various times in different storage components, and are executed by the data processor(s) of the computers. Further, each block within an illustrated flowchart may represent both method function(s), operation(s), or act(s) and one or more elements for performing the method function(s), operation(s), or act(s). In addition, depending upon the implementation, the corresponding one or more elements may be configured in hardware, software, firmware, or combinations thereof.

The present invention provides an improved cable for a cable alarm tag that includes at least one insulated conductor within and inside a second conductor, with first ends of both of the conductors mechanically and electrically connected together, and second ends of both conductors connected with an alarm system of the alarm tag, forming an electrically closed circuit, with the loop of the cable connected to an article for securing the article. With the cable of the present invention, if severed, the use of jumper cables will maintain the electrical circuit loop closed for the outer conductor only, but not the insulated and hidden inner conductor that is within and inside the insulated outer conductor. Therefore, when severing the cable to disconnect and discontinue the physical loop to remove the secured article, even if jumper cables are used, the insulated inner conductor will remain open circuited when the cable is cut, resulting in trigger of an alarm. That is, the use of the jumper cables will form a closing contact between the severed ends of the outer conductor, but cannot contact the insulated and hidden inner conductor that is severed.

Figure 3A:
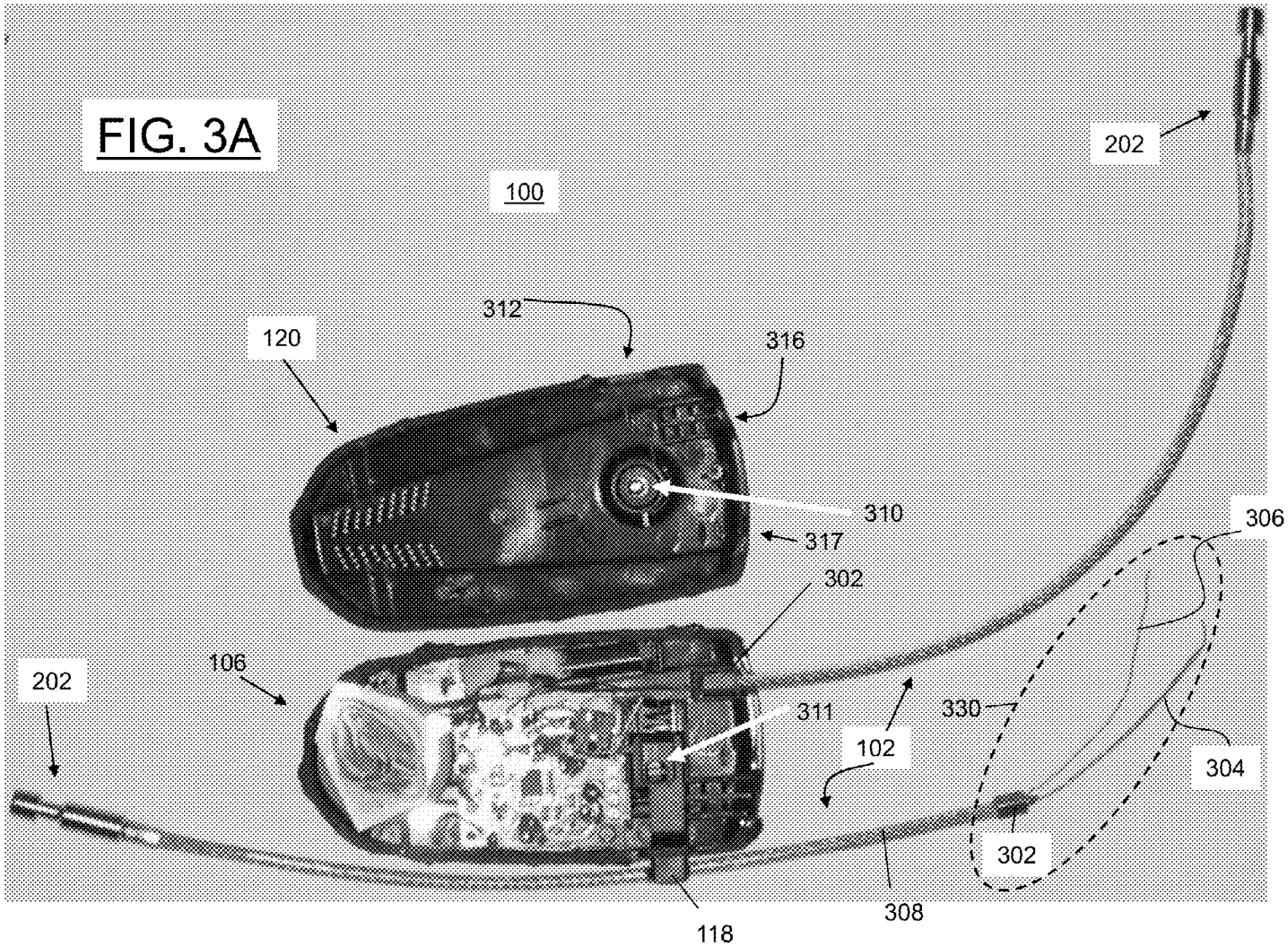
FIG. 3A is an exemplary illustration of a first and second internal chambers of respective first and second members of the cable alarm tag illustrated in FIGS. 1A to 2, with the cable in an unlocked open position, with a separate illustration of a separated cable in accordance with the present invention.
Figure 3B:
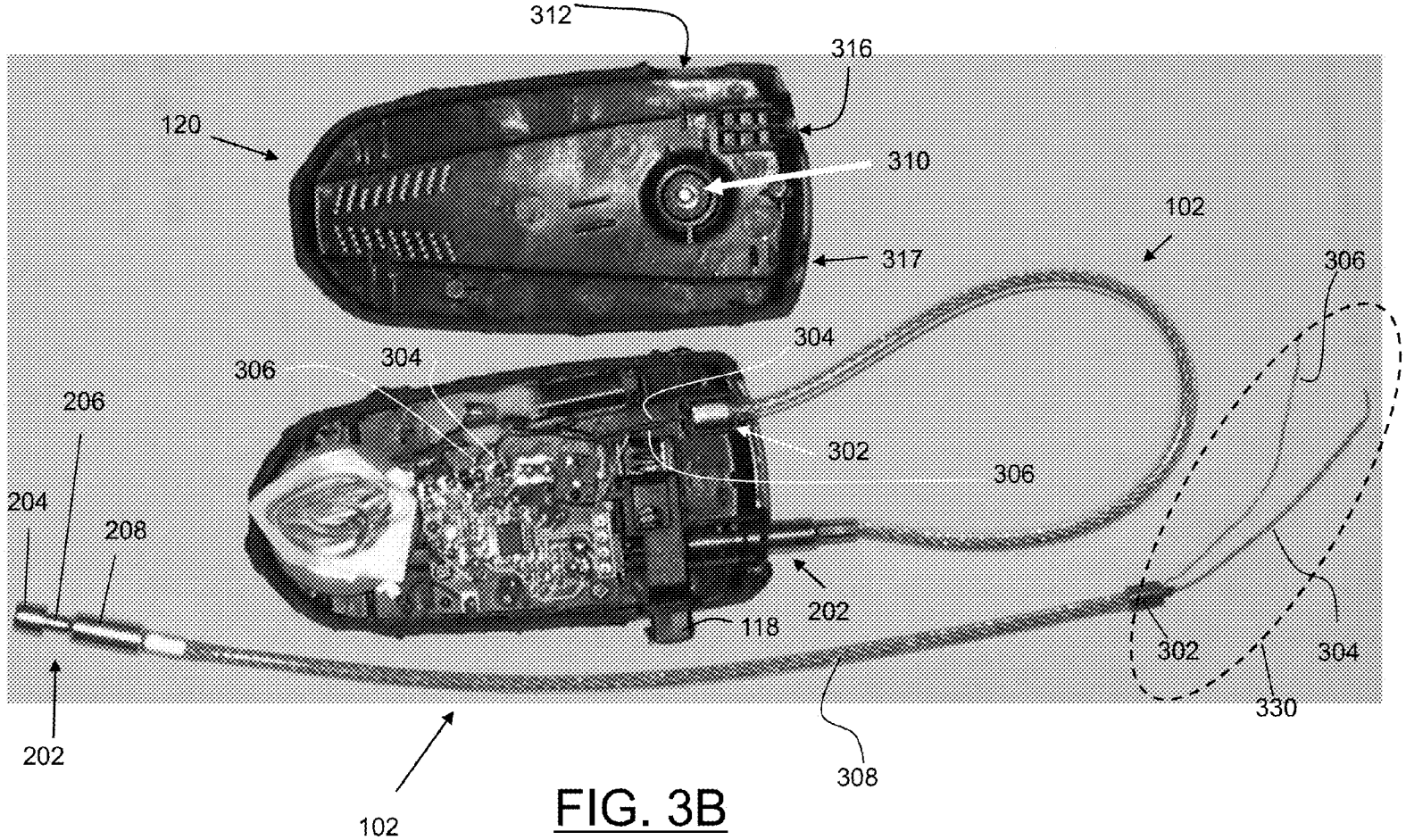
FIG. 3B is an exemplary illustration of a first and second internal chambers of respective first and second members of the cable alarm tag illustrated in FIGS. 1A to 3A, with the cable in an locked and closed position, with a separate illustration of a separated cable in accordance with the present invention.

Referring to FIGS. 1A to 1D, the present invention provides a cable alarm tag 100 having a locking cable 102 that is coupled with a housing 104 of the cable alarm tag 100. The housing 104 of the cable alarm tag 100 includes a first member 106 coupled with a second member 120, forming a hollow internal chamber within which is mounted an alarm system. The housing 104 further includes a first side that includes a first aperture for accommodating an actuator switch 118. The first member 106 includes a visual indicator aperture for viewing of a visual indicator device 108, with the second member 120 having a protuberance 114 that houses a clutch 310 (FIGS. 3A and 3D). The first member 106 and the second member 120 include perforated areas that form the grill-openings 110 of the housing 104 for output of an audio indicator sound.

Figure 1A:
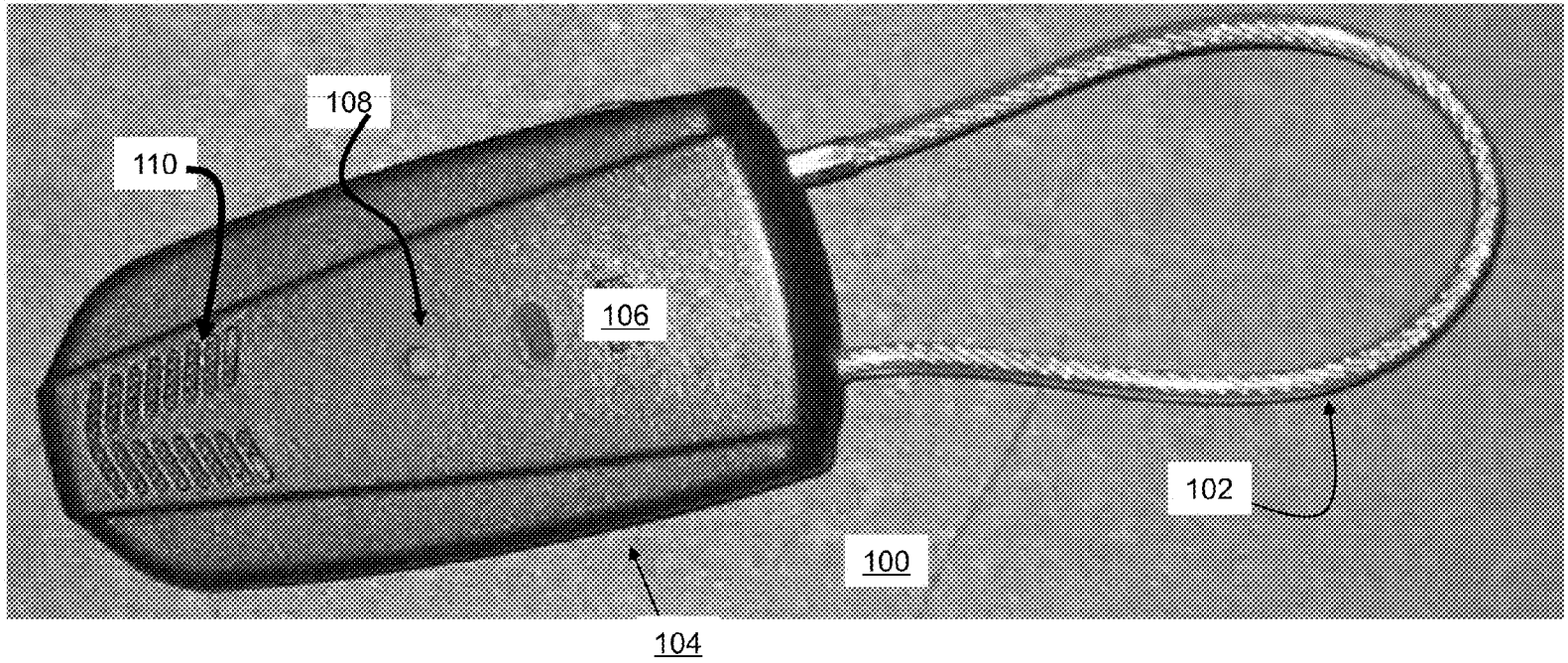
FIGS. 1A to 1D are exemplary illustration of the various views of a cable alarm tag in accordance with the present invention.
Figure 1B:
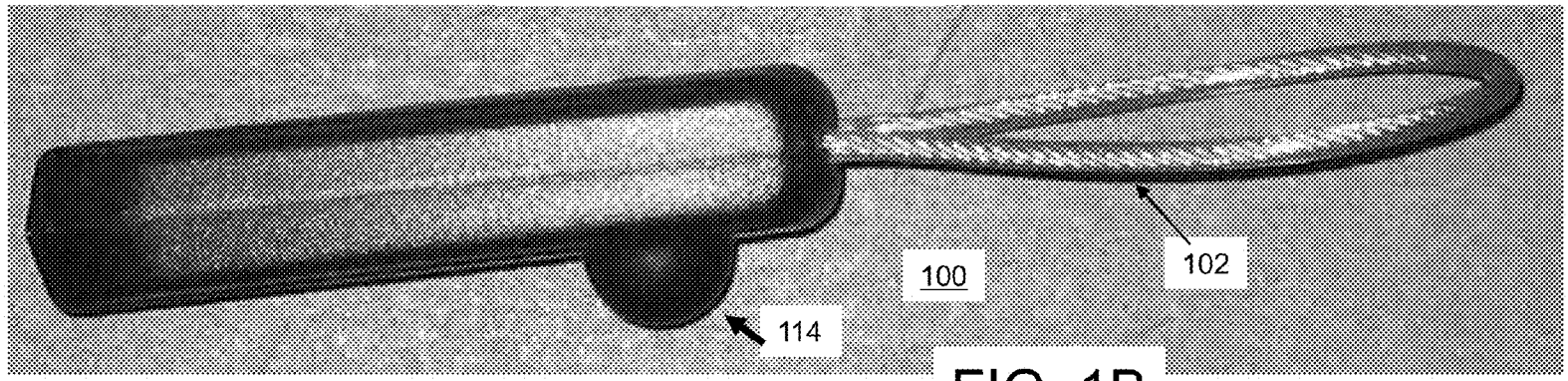
Figure 1C:
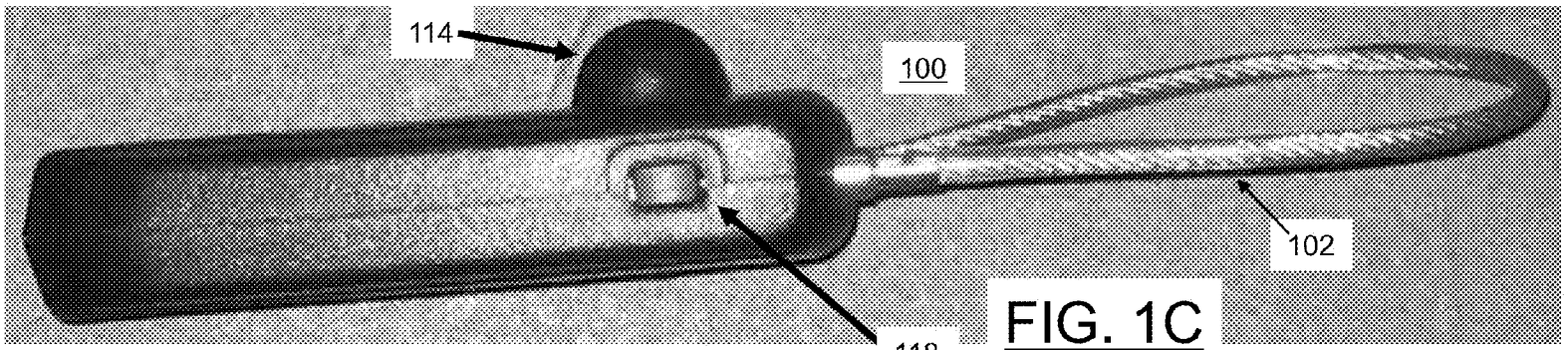
Figure 1D:
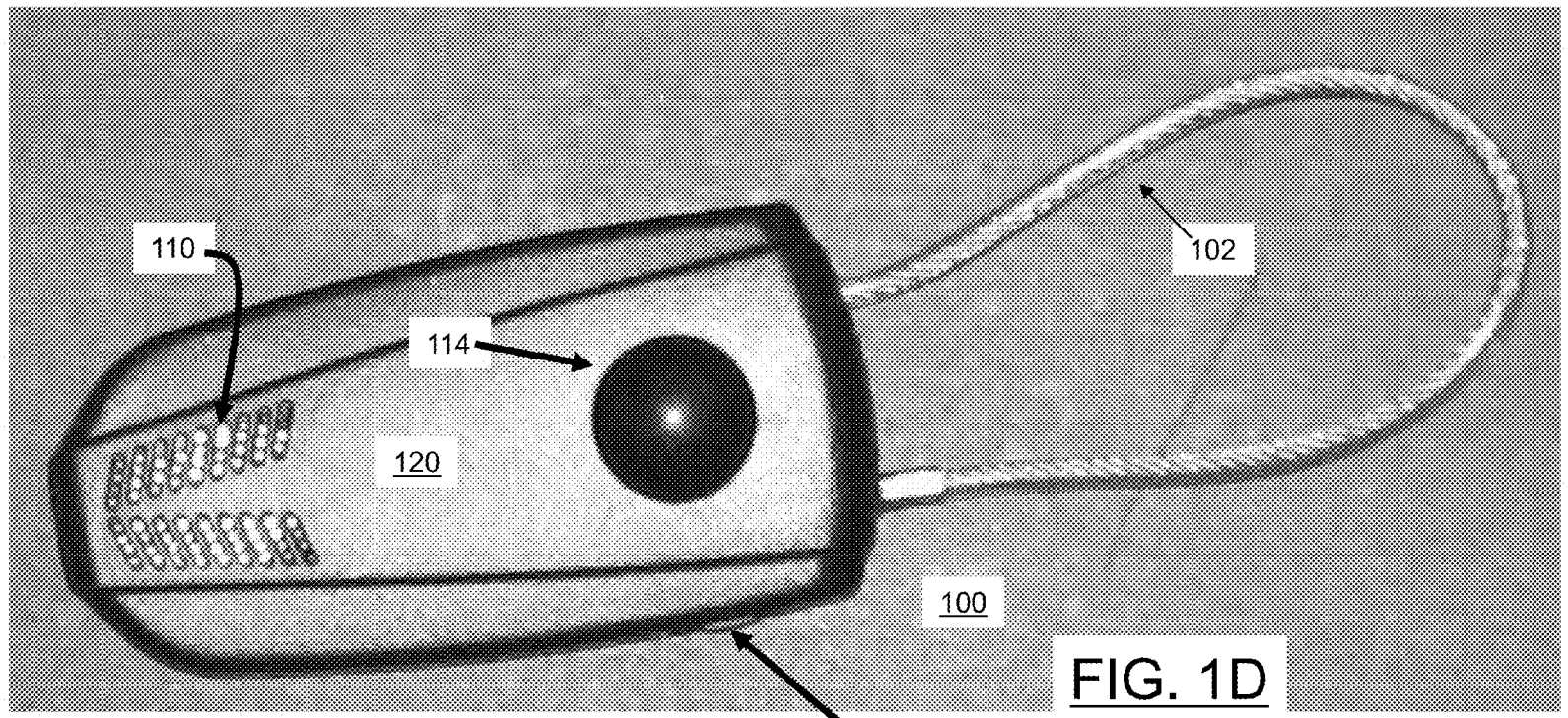
Figure 2:
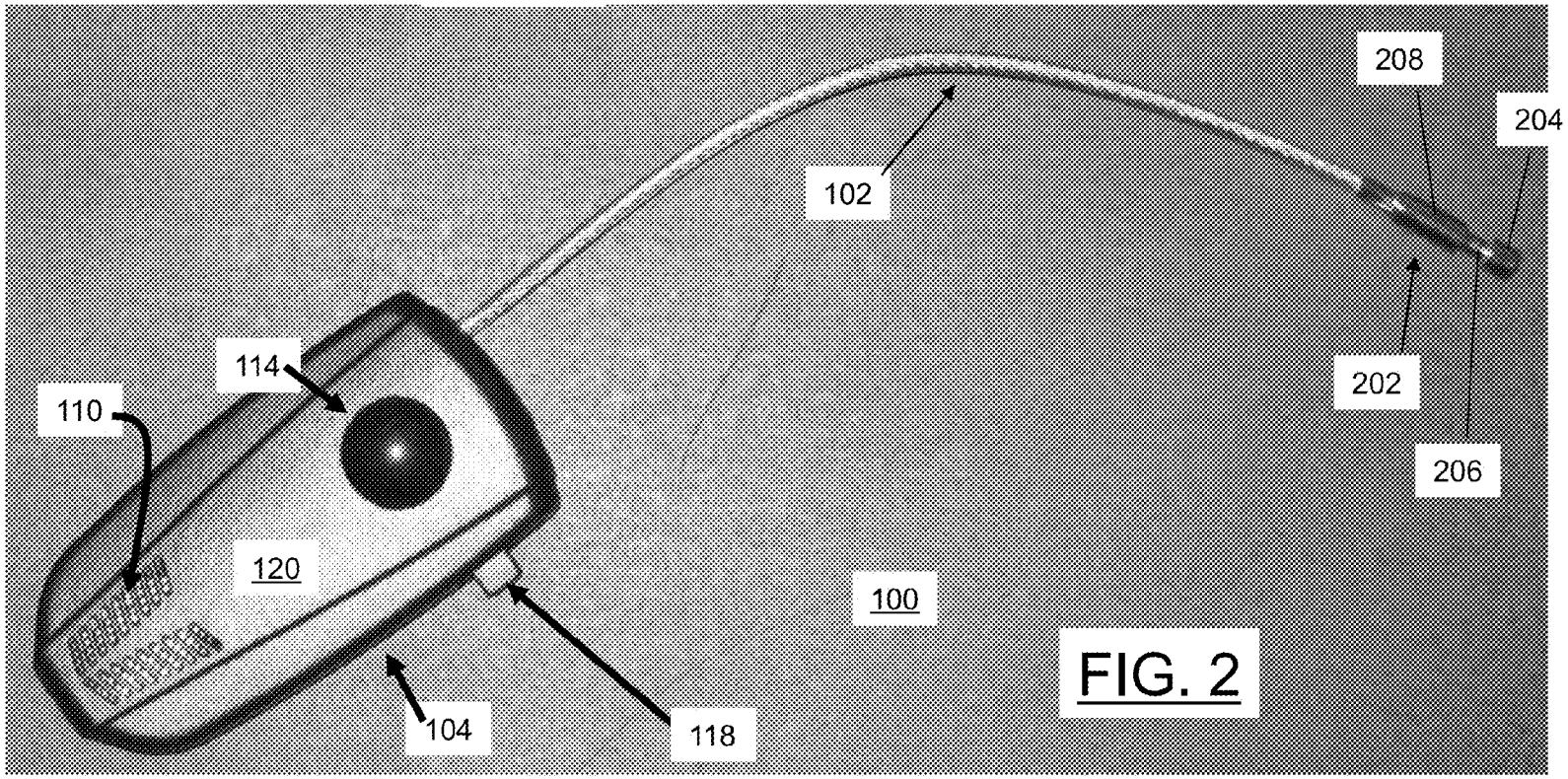
FIG. 2 is an exemplary illustration of the cable alarm tag illustrated in FIGS. 1A to 1D, but with the cable in an unlocked and open position in accordance with the present invention.

FIG. 2 is an exemplary illustration of the cable alarm tag 100 of FIGS. 1A to 1D, with the locking cable 102 in an unlocked, open position. As illustrated, when unlocked, the actuator switch 118 is extended (or protruded) out from the housing 104, enabling the removal of a locking plug 202 of the cable 102 from the housing 104. The shape, size, and any physical feature of the locking plug 202 may be varied. However, in this exemplary instance, the locking plug 202 is comprised of a substantially cylindrically tip 204, a neck section 206, and base 208.

FIGS. 3A to 3D are exemplary illustrations of the cable alarm tag 100 with the housing 104 physically separated into its first member 106 and second member 120, including illustrating a fully disconnected cable 102. As illustrated, the interior side of the second member 120 houses the clutch 310, which is biased to an interlock position (projected, raised position) by a biasing mechanism such as a spring 341. The clutch 310 inserts within and interlocks with a clutch aperture 311 to interlock and maintain the actuator switch 118 in an ON position. As further illustrated in FIGS. 3A to 3E, the interior side of the second member 120 includes a switch actuator opening 312 that accommodates the switch actuator 118, and a first cable opening 316 that accommodates the locking plug 202 of the cable 102, and a second cable opening 317 that accommodates the second distal end 330 of the cable 102.

Figure 3C:
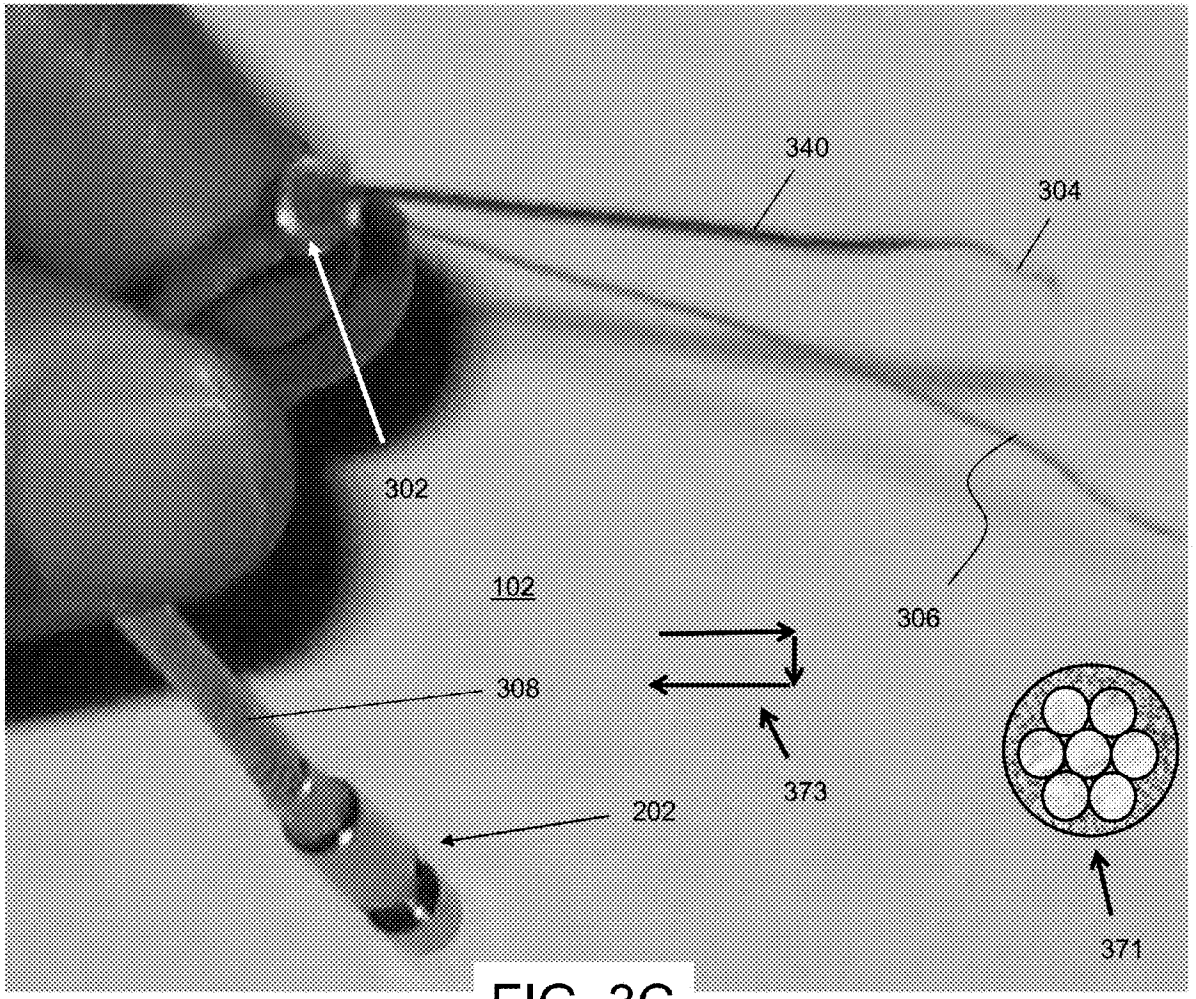
FIG. 3C is an exemplary illustrations of the cable of the cable alarm tag illustrated in FIGS. 1A to 3B in accordance with the present invention.
Figure 3D:
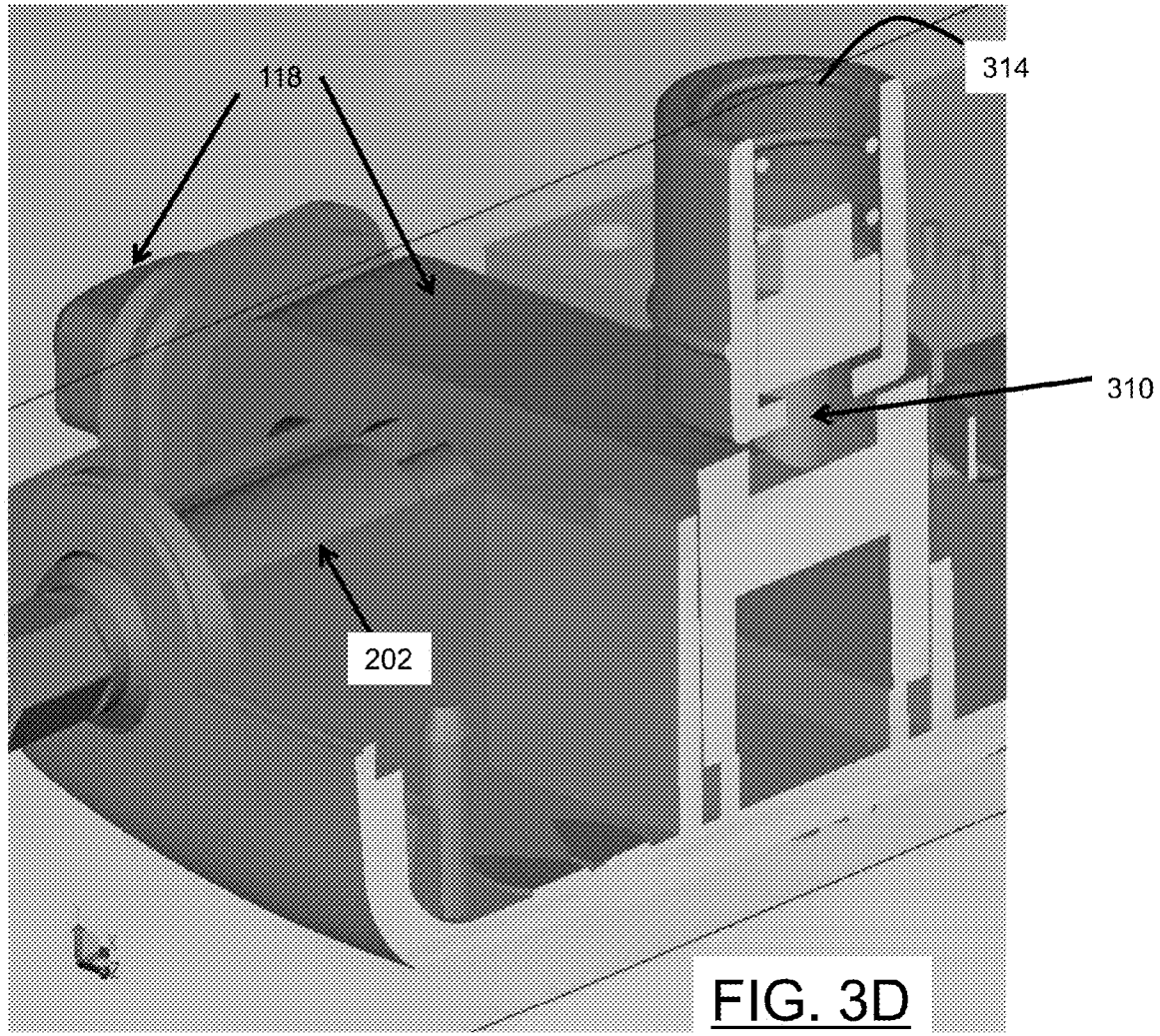
FIG. 3D is an exemplary illustration of a clutch of the cable alarm tag illustrated in FIGS. 1A to 3C in accordance with the present invention.

As further illustrated in FIG. 3C, cable 102 is comprised of one or more insulated inner conductors 304 enclosed within and inside one or more insulated outer conductors 308, with a cross-section thereof illustrated and referenced as element 371 in FIG. 3C. The inner conductors 304 are longitudinally insulated from one another and from the insulated outer conductors 308 by one or more inner dielectric layers 340. A transparent outer dielectric layer further longitudinally insulates the outermost outer conductor. In other words, all conductors are independently insulated from one another, with the exception of their first and second ends. The first distal end of the cable 102 (within the encapsulated locking plug 202) is comprised of short-circuited first ends of the inner and outer conductors 304 and 308, with the locking plug 202 encapsulating the short-circuited first ends. That is, the first end of the inner conductors 304 are mechanically and electrically connected ("pinched" together) with the first end of the outer conductors 308, forming a short-circuited return wire (referenced as 373 in FIG. 3C), and encapsulated within the locking plug 202.

The second distal end 330 of the cable 102 is comprised of second ends of the inner and outer conductors 304 and 308, which are coupled to printed circuit board, resulting in a sense loop cable. As further illustrated, the second distal end 330 further includes a conductive connector 302 that secures the inner and outer conductors 304 and 308, and securely maintains an extension 306 of the outer conductors 308. The inner and outer conductors 304 and 308 (and extension 306) are coupled with ground GND and an input of a microprocessor. Also illustrated is an insulating layer 340 for the inner conductor 304. As illustrated, at least one of the conductors (in this exemplary instance the outer conductors 308) is an internal spirally-wrapped electrical conductive cord that is bulky and strong for added mechanical strength to secure an article. Accordingly, the extension 306 (electrically and mechanical connected with the bulky outer conductor 308 via the conductive connector 302) is used as the extension of the conductor 308 so to fit inside the housing 104 of the cable alarm tag 100, and allow outer conductor 308 to mechanically and electrically connected with the electronics of the cable alarm tag 100 via the less bulky extension 306.

Figure 4A:
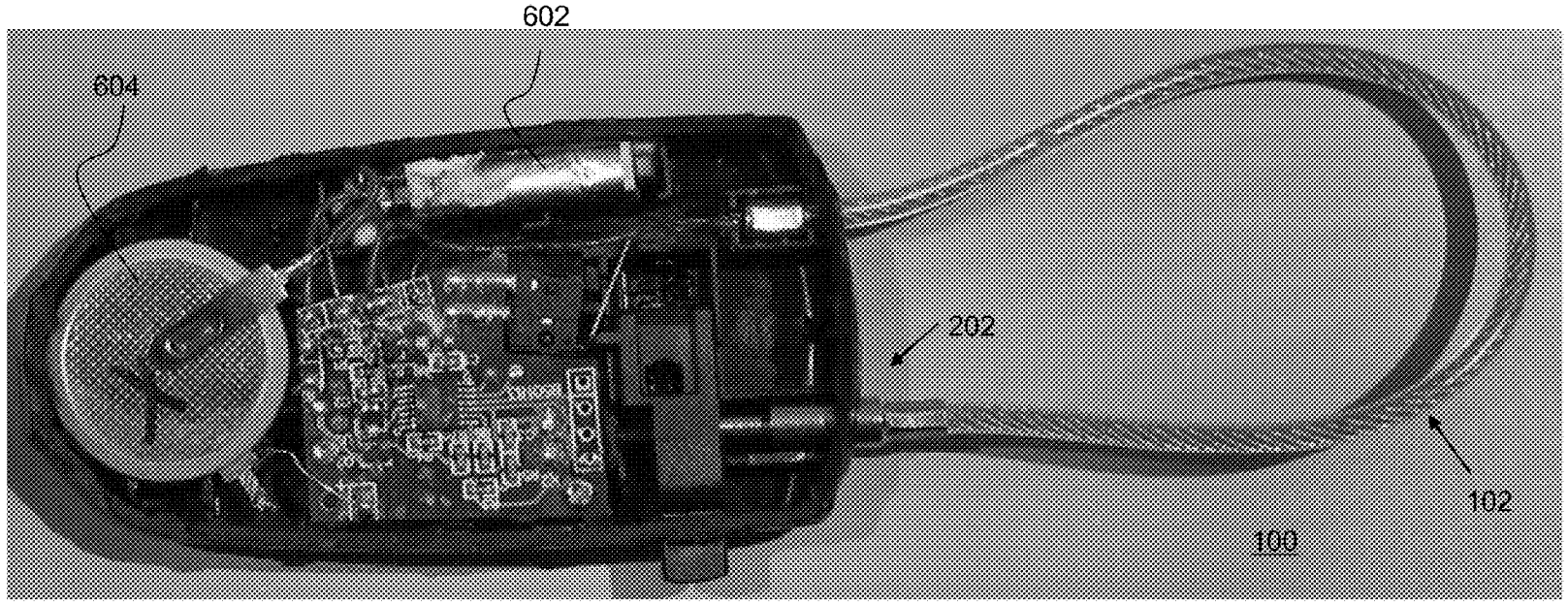
FIGS. 4A and 4B are exemplary illustration of a second internal chamber of the cable alarm tag illustrated in FIGS. 1A to 3C in accordance with the present invention.
Figure 4B:
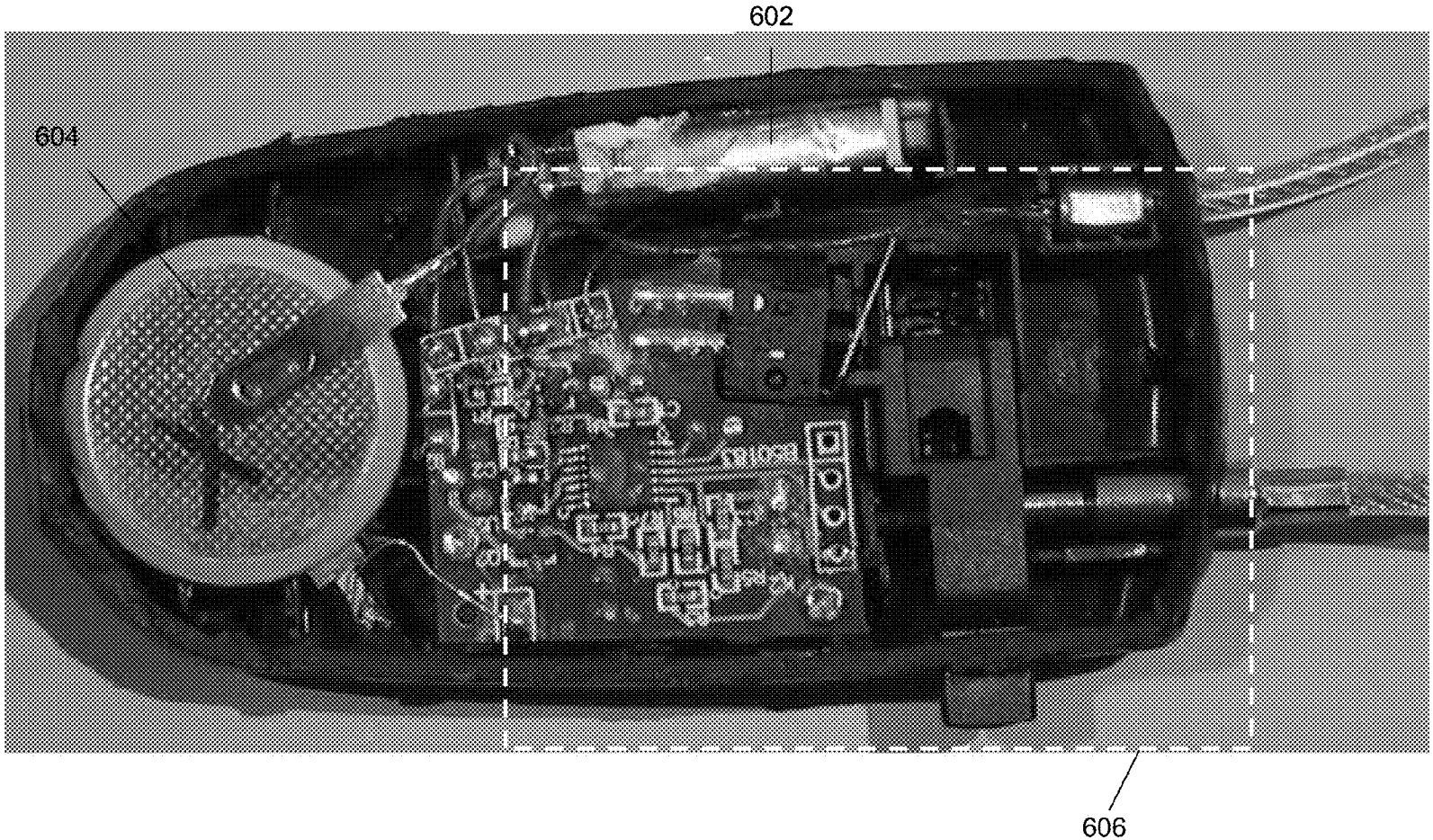
Figure 4C:
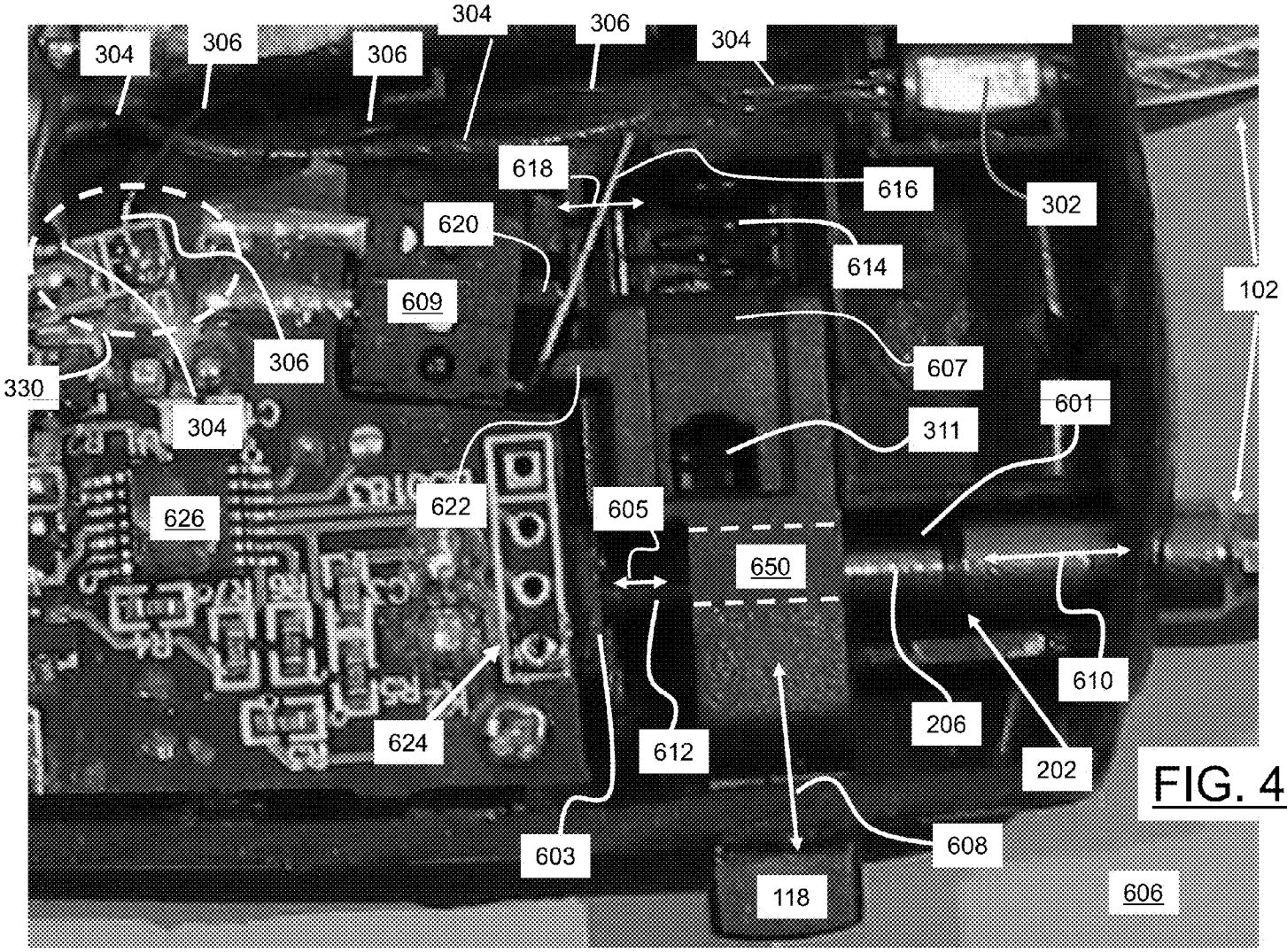
FIGS. 4C to 4D are close-up views of an area of a second internal chamber that is shown in dashed line in FIG. 4B in accordance with the present invention.

FIGS. 4A to 4C are exemplary illustrations of the mechanical and electrical interconnections of the cable alarm tag 100, including housing 104 and the cable 102 within the internal chamber of the first member 106. FIG. 4A is an over view of the internal chamber of the first member 106, illustrating various input and output periphery devices. A non-limiting example of an input periphery device is an EAS tag 602. The EAS tag 602 may be construed as a triggering unit that senses and generates surveillance signals to trigger an alarm. The non-limiting examples of EAS tags may include a magnetically sensitive device, a Radio Frequency (RF) sensitive device, or others. A non-limiting example of a magnetic sensitive device is a signal detector in the form of a ferrite coil 602, and a non-limiting example of the surveillance signal may be a magnetic signal that is detected by the ferrite coil 602. Ferrite coils 602 (and EAS Tags in general) are well-known, and can have various configurations, including different types of coil configurations (for a ferrite coil). It should be noted that an EAS tag may actuate the alarm of the cable alarm tag 100 as well as actuating an external security system such as a security gate alarm (e.g., a security pedestal). Non-limiting example of an output periphery device may include audio or visual indicators such as a transducer or an LED light.

FIG. 4B is an enlarged closer view of the first member 106 of the housing 104 of the cable alarm tag 100 with the cable 102 fully connected therewith that also illustrates a power source 604. The general area illustrated by the dashed line indicated generally by the reference number 606 is best illustrated in FIG. 4C, which closely illustrates the mechanical and electrical connections of the first and second distal ends of the cable 102 with the electrical and mechanical components within the housing 104 of the cable alarm tag 100.

As best illustrated in FIG. 4C, to activate (or arm) the cable alarm tag 100, while the switch actuator 118 is in the open or deactivated position, the locking plug 202 is inserted along the reciprocating path 610 within a locking channel 601 of the internal chamber of the first member 106 of the housing 104 of the cable alarm tag 100. The locking plug 202 is further inserted within a transversely oriented hollow portion 650 (illustrated as being underneath dashed lines) of the actuator switch 118. The actuator switch 118 is locked with the neck 206 of the locking plug 202 when the locking plug 202 is fully inserted, and the actuator switch 118 is fully moved along the reciprocating path 608 to its closed position, pushed against a biasing mechanism 614. When the locking plug 202 is fully inserted and its neck 206 interlocked with the transversely oriented hollow portion 650 of the actuator switch 118, a bottom of the locking plug 202 (the bottom is at the end of the tip 204) contacts and activates (or closes) an alarm plunger 612 of an alarm plunger switch 603. This moves the alarm plunger 612 along the reciprocating path 605. The alarm plunger switch 603 has an output coupled with a first input line of one or more input lines of a microprocessor 626 for activation (or arming) of the alarm device of the cable alarm tag 100.

As further illustrated in FIG. 4C, the actuator switch 118 is further comprised of a transversally oriented clutch aperture 311 that accommodates the clutch 310 housed in the protuberance 114 of the second member 120. When the first and second members 106 and 120 are fully coupled, the clutch 310 locks the actuator switch 118 in the active (or closed) position, against the push of the biasing mechanism 614. That is, when activating (or arming) the cable alarm tag 100, the actuator switch 118 is moved along the reciprocating path 608, pushed against the biasing mechanism 614. The clutch 310, which is biased by its own biasing mechanism 341 to a raised or protruded position, contacts the beveled distal edge 607 of the actuator switch 118, and is eventually released into the transversally oriented clutch aperture 311 to lock the actuator switch 118 in its active (or closed) position, against the biasing mechanism 614. This action also interlocks the neck 206 of the locking plug 202 of the cable 102 with the transversely oriented hollow portion 650 of the actuator switch 118. Accordingly, the mechanical biasing and interlocking interplay between the various components generates a holding strength that is increased under tensile forces that attempt to separate them from their interlocking positions.

As further illustrated 4A to 4E (best illustrated in FIG. 4E), the actuator switch 118 further includes a flange 622 that actuates a switch arm or lever 616 that contacts a power plunger arm 620 of a power plunger switch 609, which turns ON power to the alarm system of the cable alarm tag 100. Accordingly, the actuation switch 118 activates the power and arms the alarm system of the cable alarm tag 100, and maintains the activations as a result of the action of the clutch 310.

A magnetic detacher may be used to release the locking plug 202 from the internal chamber and to deactivate and turn OFF the alarm, and unlock the cable 102 to the position shown in FIG. 2. The magnetic detacher pulls in the metal clutch 310 from its normally protruded position, and out and away from the transversally oriented clutch aperture 311. This releases the actuator switch 118, with the biasing mechanism 614 pushing the actuator switch 118 to its open position along the path 608, which shuts power to the alarm device. That is, the movement of the actuator switch 118 along the path 608 will move the switch arm or lever 616 to its open position along the reciprocating path 618, which would release the power plunger arm 620 to cut power to the cable alarm tag 100. The unlock movement of the actuator switch 118 would also allow the removal of the lock plug 202 from the housing 104, which would also release the alarm plunger arm 612 to deactivate the alarm.

Figure 4D:
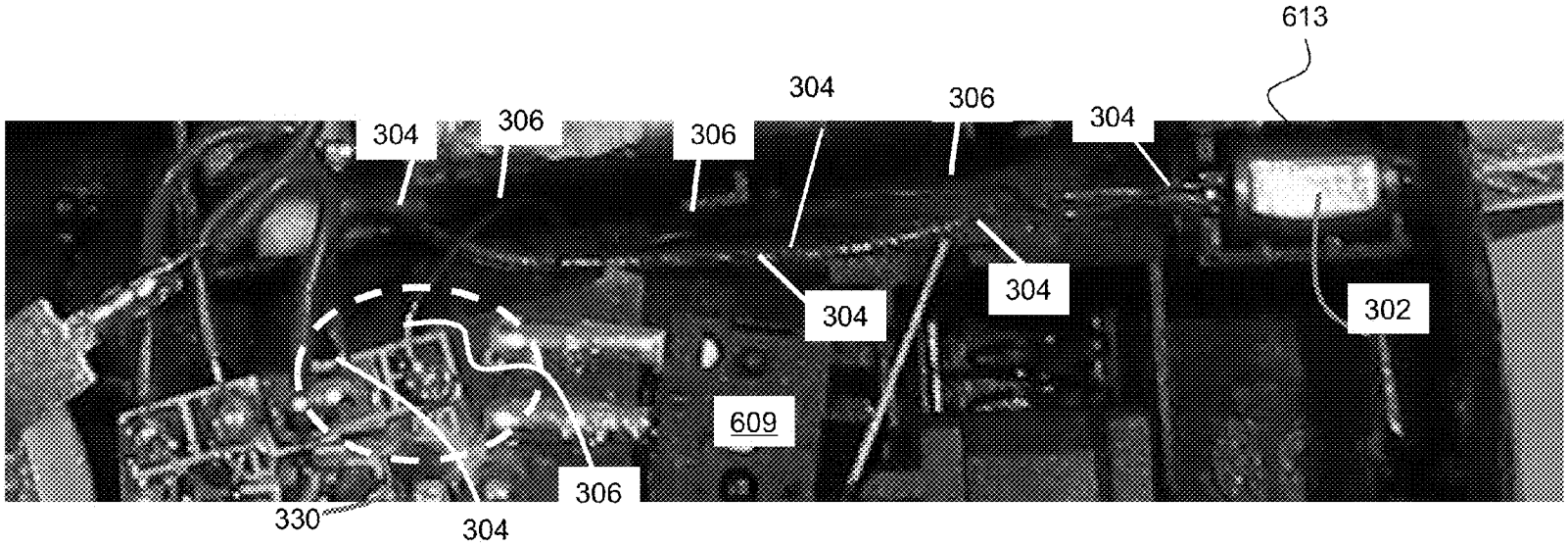
Figure 4E:
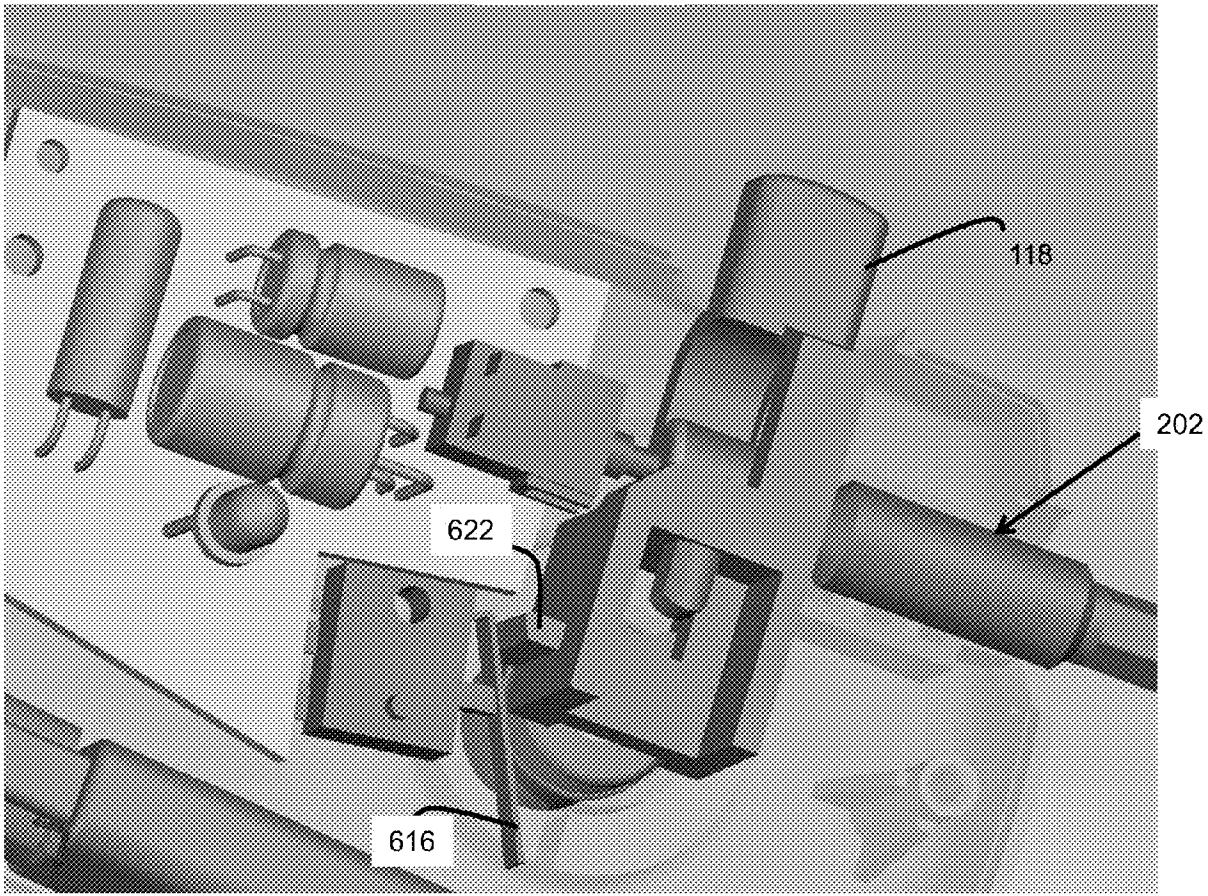
FIG. 4E is an exemplary illustration of an actuator switch of the cable alarm tag illustrated in FIGS. 1A to 4D in accordance with the present invention.

As best illustrated in FIGS. 4C and 4D, the second distal end 330 of the cable 102, is inserted through the second cable opening 317, with the conductive connector 302 housed within the internal chamber 613. The inner conductors 304 (only a single inner conductor 304 is exemplarily shown) and outer conductors 308 (via the extension 306) are coupled to a printed circuit board (PCB). The second distal end 330 of the cable 102 is further coupled with a second input line of the microprocessor via the PCB connections. Accordingly, the first ends of the insulated inner and outer conductors are short-circuited at the first distal end of the cable and encapsulated within the locking plug 202, and the second ends of the insulated inner and outer conductors are connected to the PCB, with one coupled with GND and the other coupled with an input line of the microprocessor. Therefore, severing any one of the insulated inner and or outer conductors will pull the input line signal to the microprocessor to a high, triggering an alarm signal. Accordingly, the present invention provides an improved cable that includes at least one insulated conductor within and inside the second conductor, with both conductors connected with both ends with the alarm system of the cable alarm tag 100 to form an electrical closed circuit, with the loop of the cable 102 connected to an article for securing the article. With the cable of the present invention, if severed, the use of jumper cables will maintain the electrical circuit loop closed for the outer conductor 308 only, but not the insulated inner conductor 304 that is within and inside the outer conductor 308. Therefore, when severing the cable to disconnect and discontinue the physical loop to remove the secured article, even if jumper cables are used, the inner conductor 304 will remain open circuited when cable 102 is cut, resulting in trigger of the alarm. That is, the use of the jumper cables will form a closing contact (mechanically contacting the outer cable) between the severed ends of the outer conductor due to its physical contact therewith, but cannot contact the insulated inner conductor that has also been severed and open.

Figure 5A:
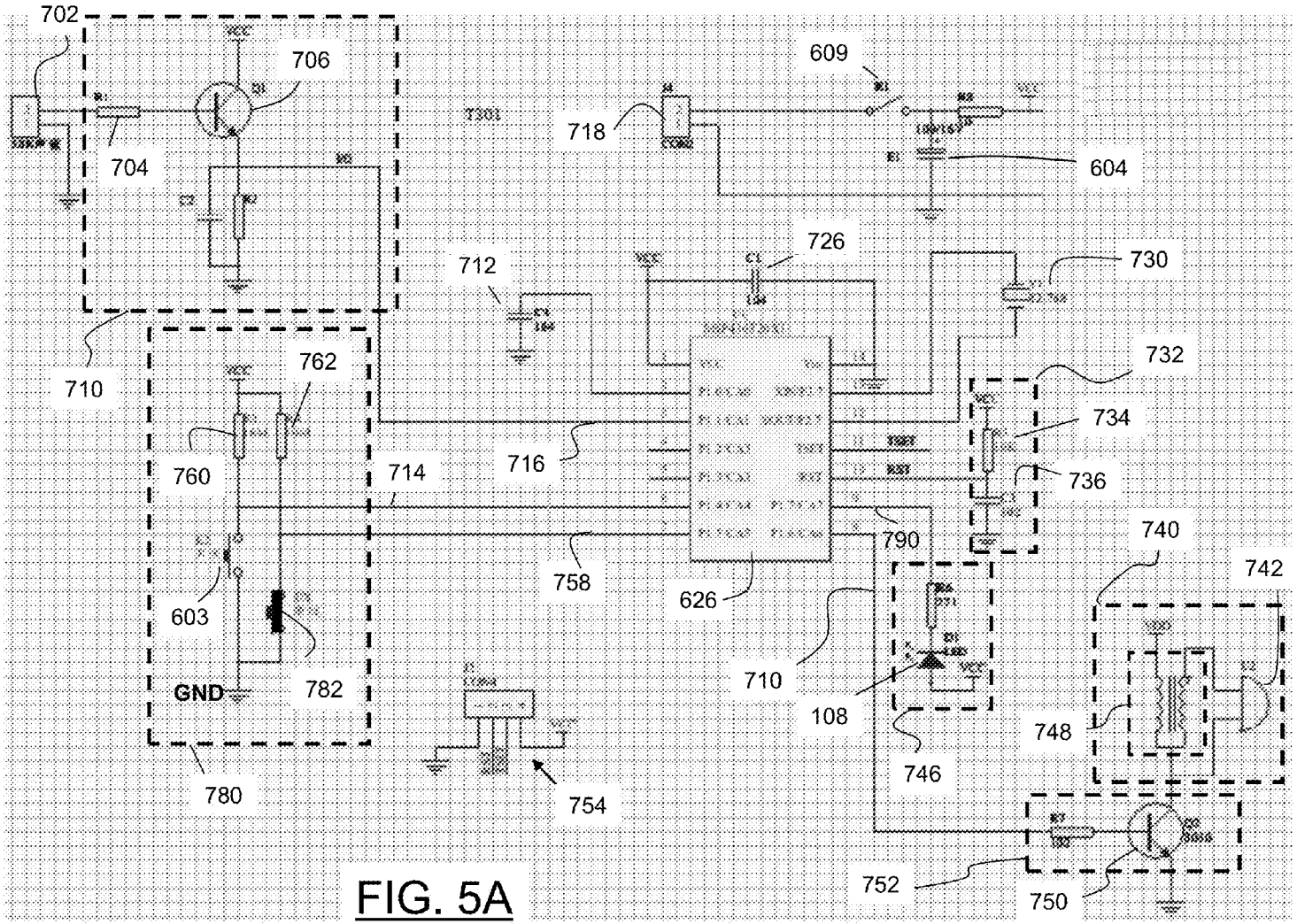
FIGS. 5A to 5C are exemplary schematic illustrations of an alarm system of the present invention in accordance with the present invention.
Figure 5B:
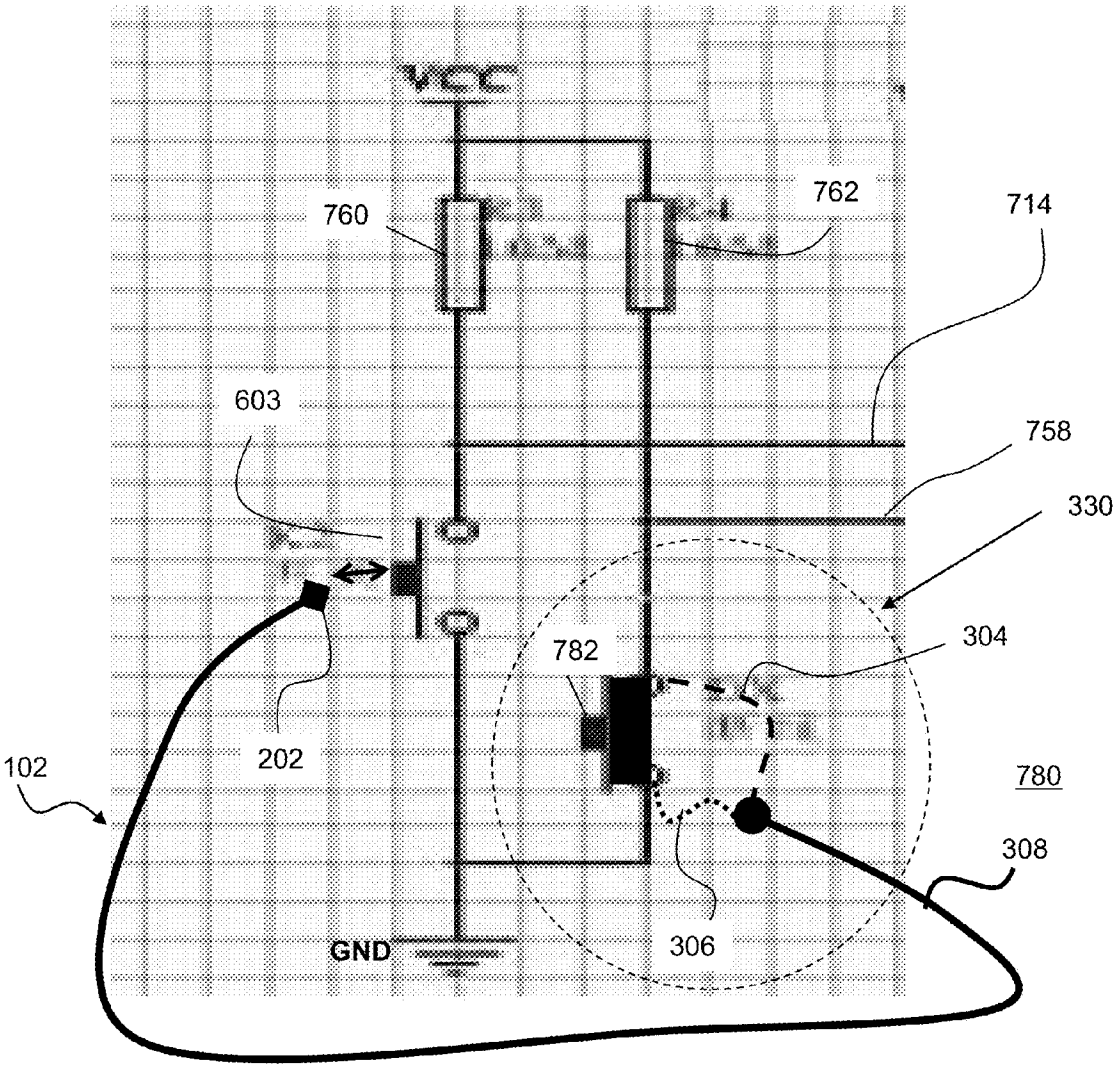
Figure 5C:
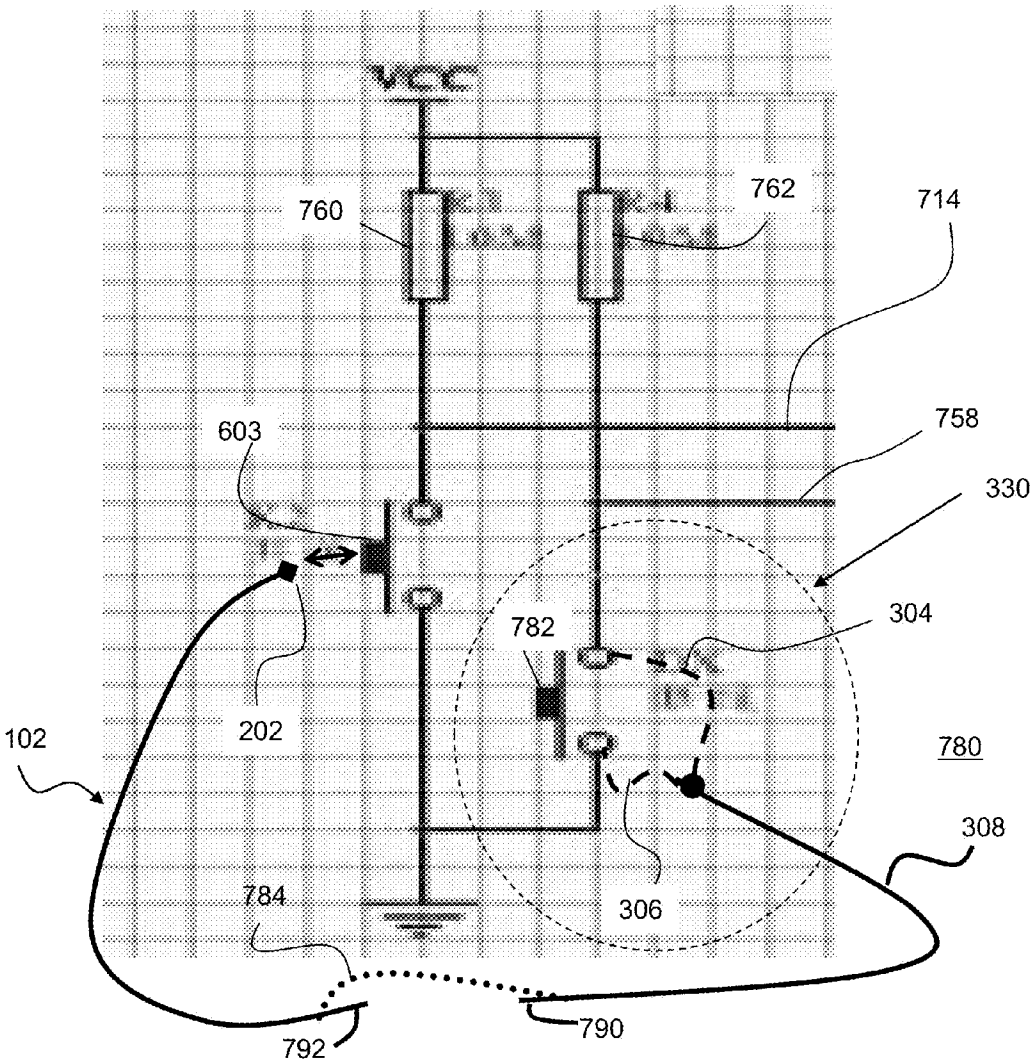

FIG. 5A to 5C are an exemplary schematic illustration of the alarm system of the present invention, including the cable 102 connections therewith. As illustrated, the alarm cable tag 100 includes a plurality of independent mechanical and electrical circuitry that function to protect an article (not shown) to which the cable alarm tag 100 is coupled for protection. A first input unit in an exemplary form of a power switch 609 has associated with it a first independent mechanical and electrical circuitry that powers ON and OFF the alarm tag 100. A second input unit in the form of the exemplary cable 102 (best illustrated in FIGS. 5B and 5C) has associated with it a second independent mechanical and electrical circuitry that enables a trigger of an alarm in case of tampering. A third input unit in the form of the exemplary arming mechanism 603 has associated with it a third independent mechanical and electrical circuitry that sets (or arms) the alarm tag and triggers an alarm in case of tampering. Finally, a fourth input unit in the exemplary form of the EAS tag 602 (such as a ferrite) that has associated with it a fourth independent mechanical and electrical circuitry (e.g., connector 702, and the amplifier 710) that receives or sends signals, and triggers an alarm in case of an unauthorized removal of an article from a secure surveillance zone.

In FIG. 5A to 5C, the dashed line indicated as reference 780 generally represents the cable 102 and its interconnections with the alarm device. The switches 603 and 609 are the same as the alarm plunger switch 603 and the power plunger switch 609 of FIG. 4C. As illustrated in FIGS. 5A to 5C, to activate (or arm) the cable alarm tag 100, the locking plug 202 is inserted within the housing 104, with the bottom of the locking plug 202 (at the end of the tip 204) contacting and activating (or closing) the alarm plunger switch 603 (best illustrated in FIGS. 5B and 5C). The alarm plunger switch 603 (shown in FIGS. 5A to 5C) is pushed as the result of the push of the locking plug 202 and is closed to pull to ground the power Vcc at one end via a current limiting resistor 760. When the switch 603 is closed by the push of the tip 202 of the locking plug 202, the output of the switch 603 (illustrated in FIGS. 5A to 5C) is pulled low and set to "0," and inputted to a first input line 714 of one or more input lines of a microprocessor 626 for activation (or arming) of the alarm device of the cable alarm tag 100. As described in relation to FIG. 4C, the actuator switch 118 further includes a flange 622 that actuates a switch arm or lever 616 that contacts a power plunger 620 of a power plunger switch 609, which turns ON power to the alarm system of the cable alarm tag 100. Therefore, the power switch 609 and the alarm switch 603 are both closed when the cable 102 is fully inserted in the alarm tag and the actuator switch 118 is actuated. When fully closed, the power switch 609 enables supply of power from the power source 604 to the alarm system illustrated in FIGS. 5A to 5C, and the output of the alarm switch 603 pulled low and set to "0" instructs the microprocessor 626 to arm the alarm.

As best illustrated in FIG. 5B, the second distal end 330 of the cable 102 is coupled with the PCB, which is schematically represented by the switch 782 for better understanding. The switch 782 is virtual and is for illustrative purpose only. Switch 782 is used only to represent the open and closed circuit conditions of the cable 102 when the cable 102 has a complete loop (i.e., switch 782 is closed) or when it is severed (i.e., switch 782 is opened). Therefore, the illustrated switch 782 is not real, but is a mere representation of open or closed condition of cable 102 closed loop circuit. Accordingly, the normal representation of this virtual "switch 782" is in its closed position (as shown in FIG. 5B) as soon as the second distal ends of the inner and outer conductors are permanently connected to the input line 758 of the microprocessor 626 via the Printed Circuit Board (PCB). Therefore, the closed switch 782 represents a complete, internally short-circuited, electrically closed-circuit loop of the cable 102 at its first distal ends (encapsulated within the lock plug 202), with its second distal ends connected to the PCB, with one of the conductors connected to the microprocessor 626 (via line 758) and the other connected to the ground GND. When the switch 782 is closed (i.e., the first distal ends of the insulated inner and insulated outer conductors are electrically and mechanically connected together and the second distal ends of the cable are mechanically and electrically connected to the input line 758 of the microprocessor 626 via the mechanical connection to the PCB and the ground), the output of the final connection (or the representative closed switch 782 shown in FIG. 5B) is pulled low and set to "0," and inputted to the input line 758 of one or more input lines of a microprocessor 626 for activation (or arming) of the alarm device of the cable alarm tag 100. With this configuration, when the lock plug 202 is removed, the switch 603 opens to disarm the plug, while the second distal end of the cable 102 permanently remains connected with the microprocessor. Accordingly, in normal conditions (activated alarm or not), the switch 782 will always remain closed as shown in FIG. 5B. However, as best illustrated in FIG. 5C, if the cable 102 is severed, the use of jumper cables 784 will maintain the electrical circuit loop closed for the outer conductor 308/306 only, but not the insulated inner conductor 304 that is within and inside the outer conductor 308, and insulate from the outer conductor 308 by the dielectric layer 340. That is, the jumper 784 may be mechanically and electrically connected to the severed ends of the 790 and 792 of the outer conductor 308, with the inner conductor severed and insulated from the outer conductor 308 and the jumper 784. Therefore, when severing the cable 102 to disconnect and discontinue the physical loop to remove the secured article, the inner conductor 304 will remain open circuited (symbolically represented as the open switch 782) when cable 102 is cut even if cable jumpers 784 are used. The open circuit condition (symbolically represented as the open switch 782) will pull the input line 758 to a high ("1"), which, in turn, will trigger the alarm.

Referring back to FIG. 5A, the alarm system further includes the general purpose microprocessor 626 mounted onto a PCB with an internal memory (e.g., an EEPROM) that includes a set of instructions. The microprocessor 626 receives one or more input signals from one or more input periphery devices and generates one or more processed output signals for actuation of one or more periphery output devices. The processing of data may include Analog to Digital (A/D) or D/A conversion of signals, and further, each input or pin of the microprocessor 626 may be coupled with various multiplexers to enable processing of several multiple input signals from different input periphery devices with similar processing requirements. Non-limiting examples of one or more input periphery devices may exemplarily include the power switch 609, the cable 102, the arming mechanisms 603, and the EAS tag 602. Non-limiting examples of one or more output periphery devices may exemplarily include the use of vibration mechanisms, audio, visual or any other indicators to alarm and notify a user regarding an occurrence.

As exemplarily illustrated in FIG. 5A, the cable alarm tag 100 may use a first input periphery device in the form of the electronic article surveillance (EAS) tag 602 coupled with an EAS connector 702, with the EAS tag 602 comprised of a ferrite unit illustrated in FIGS. 4A and 4B. As illustrated, a first output of the EAS connector 702 is coupled with ground, and a second output of the EAS connector 702 is coupled with an amplifier 710 to generate an amplified signal from the EAS tag 602. The amplifier 710 increases the signal strength from the EAS tag 602 sufficiently for further processing by the alarming circuit. The amplifier 710 is comprised of a current limiting resistor 704 that limits the current input to the base of the transistor 706, with the transistor 706 functioning to amplify the signal from EAS connector 702. The transistor 706 is comprised of an exemplary NPN Bipolar Junction Transistor (BJT), with the collector coupled to power supply Vcc and the emitter coupled to ground via a resistor-capacitor filter. It should be noted that present invention should not be limited to the amplifier 710 illustrated, and other conventional amplifiers may also be used. Further, the amplification need not be performed by the BJT, but can be done by other transistors, such as Metal Oxide Semiconductors (MOS) or MOS field effect transistors (MOSFETS), operational amplifiers, transformers, or the like, other passive or active devices, or any combination thereof.

The output of the EAS tag is amplified by the amplifier 710, and the amplified signal (form the emitter of the transistor 706) is input to the microprocessor 626 via the input line 716 as one of one or more input signals, where the microprocessor 626 converts the analog amplified signal into a digital signal for processing. This signal is translated by the instructions (algorithm) within the EEPROM of the microprocessor 626 to determine if the signal came from the transmitters (pedestals); if so, the microprocessor 626 will trigger the alarm (e.g., an audio and or visual indicator). It should be noted that one or more of the one or more processed output signals may be pulsed output signals on output line 710 to one of the one or more periphery output devices, for example, for actuation of a transducer unit 740 to generate an audio alarm signal.

The transducer unit 740 is actuated by an amplified pulsed output signal that is output from the microprocessor 626 via line 710, and further amplified by an output amplifier 752. The output amplifier 752 is comprised of a BJT transistor 750 with an emitter coupled to ground, a collector coupled to a transformer 748 of the transducer 740, and a base that is coupled with a current limiting resistor. The transistor 750 amplifies the pulsed output signal from line 710 to alternately drive the transformer from high Vcc to ground and vice versa, with the transformed pulse driving a ceramic transducer 742 to generate an audible alarm. It should be noted that a software routine within the microprocessor generates this pulsed output, which is amplified by the transistor 750. In addition to the generation of an audible alarm, as further illustrated, other output periphery devices may include the use of a visual indicator 746 that use LEDs 108 to notify users of an occurrence. The visual indicator 746 is coupled with line 790 of the microprocessor 626. As indicated above, other output periphery devices not illustrated may also easily be accommodated and connected with the microprocessor 626.

As further illustrated, pins 1 and 14 of the microprocessor 626 are respectively coupled to Vcc and ground via a filter capacitor, which power the microprocessor 626. The power is supplied to the power connector 718, and switched ON by the plunger switch 609, providing the power Vcc to the circuit. The microprocessor 626 is further coupled via its pin 2 to ground through another filter capacitor 712. The crystal 730 coupled to pin 13 is used to facilitate a clocking signal to the microprocessor 626. That is, it stabilizes the frequency of the clock in the microprocessor 626. Pins 10 and 11 are respectively for reset and test of the microprocessor 626, which is through a connector 754 that enables the testing and reset of the microprocessor 626. The testing and reset enable determination of signaling of the microprocessor 626, for example, to determine if the microprocessor 626 functions based on "0" or "1" input signal level to trigger a device. In this exemplary instance, the microprocessor 626 will trigger an output periphery device when the input is pulled to high (or "1"). For example, when the cable 102 is cut, the switch 782 is opened, pulling the line 758 to Vcc (high or "1"), which triggers an alarm. The reset pin 10 is coupled with the reset circuit 732, which includes a current limiting resistor 734 that is coupled at one end to Vcc and other end to a capacitor 736, with the other end of the capacitor 736 coupled to ground. The reset pin 10 is coupled with at the junction of the resistor 734 and capacitor 736.

Figure 6:
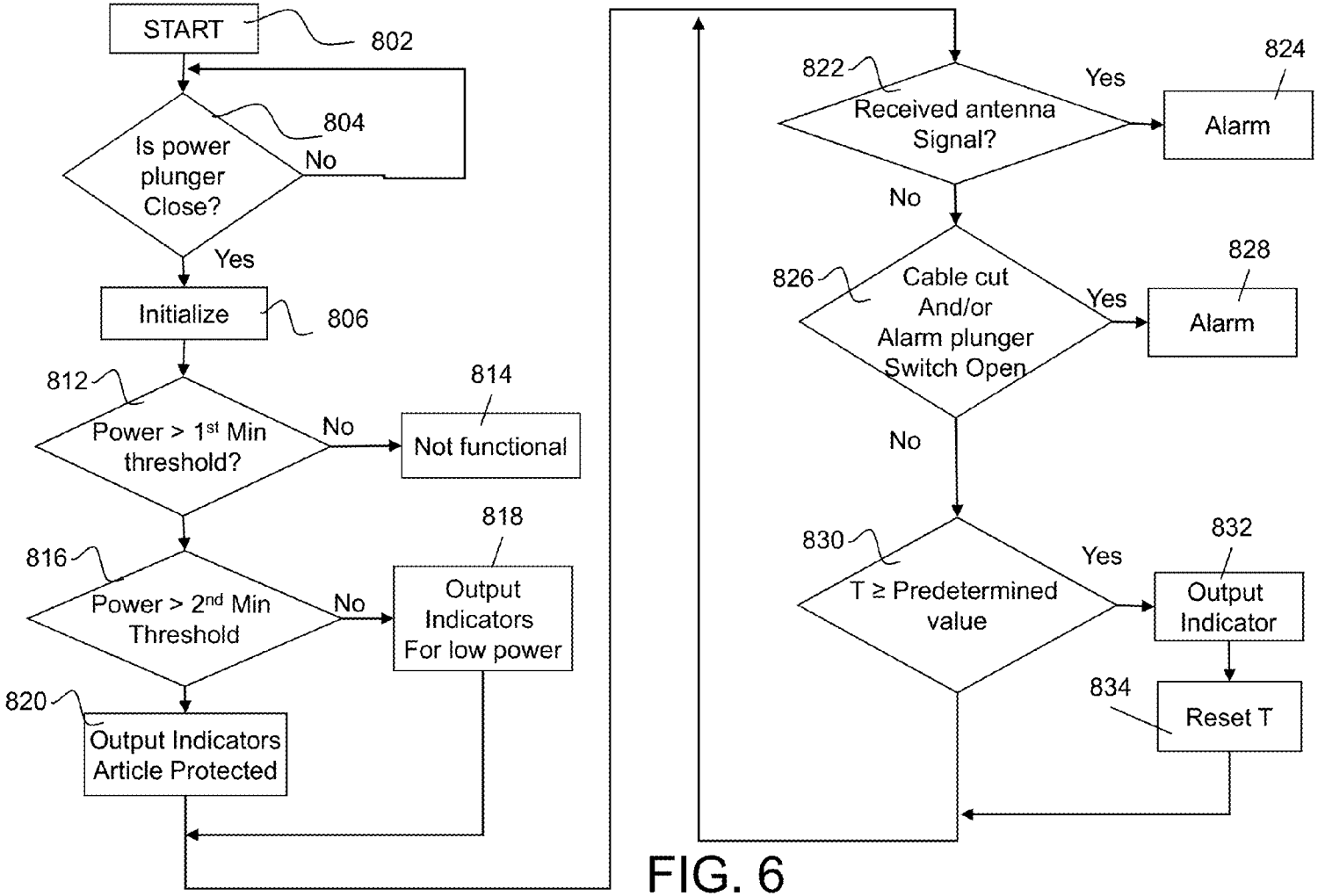
FIG. 6 is an exemplary illustration of a flow chart, which illustrates a power management and functionality of the cable alarm tag of FIGS. 1A to 5C in accordance with the present invention.

FIG. 6 is an exemplary flow chart, which illustrates the power management and functionality of the microprocessor 626 for the cable alarm tag 100. As illustrated, upon start of the program at the operational act 802, the microprocessor 626 at the next operational act 804 determines if the power plunger switch 609 is closed. If the microprocessor 626 determines that the power plunger 609 is closed, then it initializes at the operational act 806, and at the operational act 812 the microprocessor 626 determiners if supplied power is greater than a first threshold level. If at the operational act 812 it is determined that supplied power is not greater than a first threshold level, the device is non-functional (operational act 814). Otherwise, if at the operational act 812 the microprocessor 626 determines that supplied power is greater than the first threshold, the microprocessor 626, at the operational act 816, determines if the supplied power is greater than a second threshold level, with the second threshold level greater than the first threshold level. If the microprocessor 626 determines that the supplied power is not greater than a second threshold level, the microprocessor 626 at the operational act 818 activates various output periphery units in certain manner to indicate low supply of power, but continues and activates the alarm to protect an article. If the microprocessor 626 determines that the supplied power is greater than the second threshold level, the alarm is set (or armed), and various indicators are activated to indicate to user that the article is protected.

To continue with the flowchart of FIG. 8, the microprocessor 626 at the operational act 822 determines if an antenna signal is received from an associated EAS device equipment (via the EAS tag 602). If the microprocessor 626 determines that such an antenna signal is received, at the operational act 824 the microprocessor 626 activates (or triggers) an alarm. A non-limiting example for such an alarm incident (or condition) is the actual removal of the article to which the cable alarm tag 100 is connected from a store, passing them through a surveillance zone. This will activate the EAS tag 602 to trigger a signal, which will be amplified (via the amplifier 710) and input to the microprocessor 626 to activate (or trigger the alarm). If the microprocessor 626 determines that no such antenna signal was received, the microprocessor 626, at the operational act 826 determines if the cable 102 has been cut or the alarm plunger switch 603 is open. If the microprocessor 626 determines that the cable is cut and or the alarm plunger switch 603 is open, at the operational act 828 the microprocessor 626 activate (or triggers) the alarm, which indicates an actual tampering of the cable alarm tag 100. On the other hand, if the microprocessor 626 determines that the cable 102 is not cut and the alarm plunger switch 603 is closed, at functional act 830 a determination is made regarding a timer to determine if a predetermined time has been reached. If at functional act 830 it is determined that a predetermined time has elapsed, an indicator is output and the timer is reset, where the microprocessor 626 then repeats operational functional act 822, which is to determine if an antenna signal has been received. The output indicator 832 is an audio and or visual indicator that enables a user to determine if the tag 100 is properly armed. The microprocessor 626 output a visual and or audio indicator periodically (while the tag 100 is armed) at specified predetermined time intervals T.

Although the invention has been described in considerable detail in language specific to structural features and or method acts, it is to be understood that the invention described and shown in the drawings should not be limited to the specific features or acts described and shown. Rather, the specific features and acts are disclosed as preferred forms of implementing the invention. Stated otherwise, it is to be understood that the phraseology, terminology, and various measurements employed herein are for the purpose of description and should not be regarded as limiting. Therefore, while exemplary illustrative embodiments of the invention have been described and shown, numerous variations and alternative embodiments will occur to those skilled in the art. For example, replacing cable 102 with an infrared sensor circuit, a motion detector circuit, an accelerometer circuit, a magnet detector circuit, a radiation detection circuit, or with any type of sensor or any combinations thereof. Such variations and alternate embodiments are contemplated, and can be made without departing from the spirit and scope of the invention.

It should further be noted that throughout the entire disclosure, the labels such as left, right, front, back, top, bottom, forward, reverse, clockwise, counter clockwise, up, down, or other similar terms such as upper, lower, aft, fore, vertical, horizontal, oblique, proximal, distal, parallel, perpendicular, transverse, longitudinal, etc. have been used for convenience purposes only and are not intended to imply any particular fixed direction or orientation. Instead, they are used to reflect relative locations and/or directions/orientations between various portions of an object.

In addition, reference to "first," "second," "third," and etc. members throughout the disclosure (and in particular, claims) is not used to show a serial or numerical limitation but instead is used to distinguish or identify the various members of the group.

In addition, any element in a claim that does not explicitly state "means for" performing a specified function, or "step for" performing a specific function, is not to be interpreted as a "means" or "step" clause as specified in 35 U.S.C. Section 112, Paragraph 6. In particular, the use of "step of," "act of," "operation of," or "operational act of" in the claims herein is not intended to invoke the provisions of 35 U.S.C. 112, Paragraph 6.

What is claimed is:

1. A cable, comprising:

a sense loop, having inner conductors enclosed within outer conductors;

the inner conductors longitudinally insulated from one another and from the outer conductors by inner dielectric layers, with an outermost outer conductor of the outer conductors longitudinally insulated by an outer dielectric layer;

a first distal end of the cable is comprised of first ends of the inner and outer conductors that are directly connected together, and a second distal end of the cable is comprised of second ends of the inner and outer conductors.

2. The cable as set forth in claim 1, wherein:

the first distal end includes a locking plug that encapsulates the first end of the inner and outer conductors.

3. The cable as set forth in claim 1, wherein:

the locking plug interlocks with and is accommodated by an actuator of an alarm tag.

4. The cable as set forth in claim 1, wherein:

the second distal end includes a conductive connector that secures the inner and outer conductors, and securely maintains an extension of the outer conductors.

5. The cable as set forth in claim 1, wherein:

at least one conductor is an internal spirally-wrapped electrical conductive cord for added mechanical strength.

6. A cable, comprising:

a sense loop, having a conductor and at least one auxiliary conductor enclosed within the conductor;

the auxiliary conductor longitudinally insulated from the conductor by an inner dielectric layer, with the conductor longitudinally insulated from outside by an outer dielectric layer;

a first distal end of the cable is comprised of direct connection of a first end of the conductor with a first end of the auxiliary conductor, and a second distal end of the cable is comprised of a second end of the conductor and the auxiliary conductor.

7. A cable alarm tag, comprising:

a sense loop conductive cable, having a conductor and at least one auxiliary conductor enclosed within the conductor;

the auxiliary conductor longitudinally insulated from the conductor by an inner dielectric layer, with the conductor longitudinally insulated from outside by an outer dielectric layer;

a first distal end of the cable is comprised of a locking plug that encapsulates first ends of the conductor with the auxiliary conductor, with the first ends of the conductor and the auxiliary conductor directly connected together;

a second distal end of the cable is comprised of second ends of the conductor and the auxiliary conductor, with the first and second distal ends of the cable forming the sense loop conductive cable.

8. The cable alarm tag as set forth in claim 7, wherein:

the locking plug is accommodated in a locking channel of an internal chamber of a housing component of an alarm tag, and inserted within a transversely oriented hollow portion of an actuator and locked when the locking plug is fully inserted and the actuator is moved to an active position; and when fully inserted, a base of the locking plug contacts and activates a first plunger of a first plunger switch; with the first plunger switch having a first output coupled with a first input line of a microprocessor for activation of the alarm device of the alarm tag.

9. The cable alarm tag as set forth in claim 8, wherein:

the second distal end of the cable is further coupled with a second input line of a microprocessor; and severing any one of the auxiliary and outer conductors would pull one of the first and second input line signals to the microprocessor to a high, triggering an alarm signal.

* * * * *